US012594458B1

(12) United States Patent
Serodio

(10) Patent No.: US 12,594,458 B1
(45) Date of Patent: Apr. 7, 2026

(54) EXERCISE APPARATUS

(71) Applicant: Kate Serodio, Hampton, NH (US)

(72) Inventor: Kate Serodio, Hampton, NH (US)

( * ) Notice: Subject to any disclaimer, the term of this patent is extended or adjusted under 35 U.S.C. 154(b) by 111 days.

(21) Appl. No.: 18/364,805

(22) Filed: Aug. 3, 2023

Related U.S. Application Data

(60) Provisional application No. 63/370,311, filed on Aug. 3, 2022.

(51) Int. Cl.
*A63B 23/08* (2006.01)
*A63B 21/055* (2006.01)

(52) U.S. Cl.
CPC ..... *A63B 23/08* (2013.01); *A63B 21/0557* (2013.01)

(58) Field of Classification Search
CPC ..... A63B 23/08; A63B 21/0557
See application file for complete search history.

(56) References Cited

U.S. PATENT DOCUMENTS 2,062,909 A 12/1936 Kenagy, Sr. et al.
2,173,969 A 9/1939 Klaff
2,177,571 A 10/1939 Kirke
2,193,943 A 3/1940 Shea
2,254,184 A 8/1941 Mayer
2,283,273 A 5/1942 Marcy
2,478,664 A 8/1949 Morrow et al.
4,596,387 A 6/1986 Roberts
4,728,103 A * 3/1988 Fulton ..... A63B 23/085 482/125
5,545,113 A 8/1996 Bobich
5,687,492 A 11/1997 Muraoka
6,368,258 B1 4/2002 Emlaw
6,681,502 B1 1/2004 Birkenstock
7,794,368 B2 9/2010 Rutherford
7,955,236 B2 * 6/2011 DiGiovanni ..... A63B 21/0552 482/129
8,826,571 B2 9/2014 Rutherford
9,005,090 B2 4/2015 Latronica
9,586,082 B2 * 3/2017 Cranke ..... A63B 21/00065
9,821,189 B1 * 11/2017 Saar ..... A63B 21/4015
(Continued)

OTHER PUBLICATIONS

Booty Boot—Multifunctional Glute Kickback and Leg Exercise Attachment Ankle Straps (Pair—2 Count) Strengthen Tone and Build Butt Quads Hamstrings Abductors and Abductors 100% Guaranteed; Website screenshot acquired Jan. 31, 2024; 6 pages.
(Continued)

*Primary Examiner* — Andrew S Lo
(74) *Attorney, Agent, or Firm* — Grossman, Tucker, Perreault & Pfleger, PLLC; Michael J. Gallagher

(57) ABSTRACT

An exercise apparatus, comprising a foot holder; the foot holder including a pull strap and a strap guide; the strap guide positioned such that the strap guide lies adjacent a top side of a midfoot section of a foot and/or lies adjacent one or more metatarsals of a forefoot section of the foot; a pull strap positioned such that the pull strap extends from a bottom side of the foot around one or more phalanges of the foot and along the top side of the foot to the strap guide; and the pull strap arranged with the strap guide such that, when a pulling force is applied to the pull strap, the pull strap slides through the strap guide to direct the pulling force along the top side of the foot around the one or more phalanges of the foot to the bottom side of the foot.

21 Claims, 28 Drawing Sheets

(56) References Cited

U.S. PATENT DOCUMENTS

| | | | | |
|---|---|---|---|---|
| 9,914,004 | B2 * | 3/2018 | Hatfield | A61H 1/0266 |
| 10,206,452 | B2 | 2/2019 | Ramirez, II | |
| 10,933,274 | B2 * | 3/2021 | Negron | A63B 21/4017 |
| 11,358,021 | B2 * | 6/2022 | Harding | A63B 21/0557 |
| 11,660,493 | B2 * | 5/2023 | Saar | A63B 21/4011 482/79 |
| 2004/0147378 | A1 * | 7/2004 | Conklin | A63B 21/169 482/124 |
| 2005/0043150 | A1 * | 2/2005 | Nitta | A63B 21/4015 482/79 |
| 2005/0096201 | A1 * | 5/2005 | Thelen | A63B 69/0022 482/121 |
| 2006/0183609 | A1 * | 8/2006 | Flynn | A63B 21/4011 482/124 |
| 2007/0191193 | A1 * | 8/2007 | Backes | A61H 1/0266 482/79 |
| 2009/0149303 | A1 * | 6/2009 | Meisterling | A63B 69/002 482/131 |
| 2010/0050473 | A1 * | 3/2010 | Rosso | A63B 21/4015 36/105 |
| 2011/0258885 | A1 | 10/2011 | Rutherford | |
| 2016/0101309 | A1 * | 4/2016 | Schreiber | A63B 21/00065 482/124 |
| 2016/0143387 | A1 | 5/2016 | Alfonso | |
| 2016/0256732 | A1 * | 9/2016 | Kasner | A63B 23/1281 |
| 2016/0345656 | A1 * | 12/2016 | Ramirez, II | A63B 21/4043 |
| 2018/0036577 | A1 * | 2/2018 | Leary | A63B 21/4015 |
| 2018/0078813 | A1 * | 3/2018 | Saar | A63B 23/03508 |
| 2018/0200559 | A1 * | 7/2018 | Papashvili | A63B 23/08 |
| 2018/0290009 | A1 * | 10/2018 | Avila | A63B 21/4015 |
| 2019/0126091 | A1 * | 5/2019 | Griffin | A63B 21/4013 |
| 2020/0197743 | A1 * | 6/2020 | Biele | A63B 21/4025 |

OTHER PUBLICATIONS

FlexBand—Foot & Lower Back Stretcher—mLab; Website screenshot acquired Jan. 31, 2024; 18 pages.

* cited by examiner 200
201
202
202

42
50
44
60

42
50
44
60

46
42
7C, 7E
7D, 7F
44
7D, 7F
7C, 7E
40
60
50
48

44
58
200
195
196
201
50
61
63
62
60
40

58
200
195
196
201
50
60
40

EXERCISE APPARATUS

CROSS-REFERENCE TO REPLATED APPLICATIONS

The present application claims the benefit of U.S. Provisional Application Ser. No. 63/370,311 filed Aug. 3, 2022, which is hereby incorporated by reference in its entirety.

FIELD

The present disclosure relates to an exercise apparatus for a human, and more particularly a free-standing exercise apparatus which is attachable to a human to facilitate therapeutic exercise of various body regions, such as to increase mobility and flexibility.

BACKGROUND

Many individuals suffer from inadequate dorsiflexion of the foot, which may result from tightness of the plantar fascia, Achilles tendon and calves, which can result in pain, immobility and injury. The present disclosure provides exercise apparatus which assist in increasing dorsiflexion of the foot.

SUMMARY

An exercise apparatus is disclosed, comprising a foot holder to be disposed on a human foot; the foot holder including a pull strap and a strap guide; the strap guide positioned such that, when the foot holder is disposed on the foot, the strap guide lies adjacent a top side of a midfoot section of the foot and/or lies adjacent one or more metatarsals of a forefoot section of the foot; a pull strap positioned such that, when the foot holder is disposed on the foot, the pull strap extends from a bottom side of the foot around one or more phalanges of the foot and along the top side of the foot to the strap guide; and the pull strap arranged with the strap guide such that, when a pulling force (F) is applied to the pull strap, the pull strap slides through the strap guide to direct the pulling force (F) along the top side of the foot around the one or more phalanges of the foot to the bottom side of the foot, whereby the bottom side of the foot is brought into tension by the pulling force (F).

In at least one embodiment, the pull strap is fastened to the foot holder at a location of the foot holder positioned to lie adjacent the bottom side of the foot.

In at least one embodiment, the location of the foot holder positioned to lie adjacent the bottom side of the foot is at the forefoot section and/or at the midfoot section of the foot.

In at least one embodiment, the foot holder further comprises a central section, comprising an adjustable length loop, positioned to encircle the forefoot section and/or the midfoot section of the foot; and the pull strap is fastened to the adjustable length loop.

In at least one embodiment, the pull strap is permanently fastened to the adjustable length loop with thread.

In at least one embodiment, the strap guide is coupled to the adjustable length loop by a strap guide anchor loop permanently fastened to the adjustable length loop with thread.

In at least one embodiment, the foot holder further comprises a rearward section which extends around a hindfoot section of the foot and is fastened to the central section at a position to lie adjacent an inner side and at a position to lie adjacent an outer side of the foot.

In at least one embodiment, the rearward section is permanently or releasably fastened to the central section at the positions to lie adjacent the inner side and at the position to lie adjacent the outer side of the foot with thread.

In at least one embodiment, the foot holder further comprises a toe region section, comprising a loop, positioned to encircle a toe region of the forefoot section of the foot; and In at least one embodiment, the loop includes a ring through which the pull strap passes through.

In at least one embodiment, the pull strap is fastened to the foot holder at a location of the foot holder positioned to lie adjacent a hindfoot section of the foot.

In at least one embodiment, the location of the foot holder is positioned to lie adjacent the hindfoot section of the foot is at a rear end of the hindfoot section of the foot.

In at least one embodiment a rearward section is positioned to lie adjacent the hindfoot section of the foot at a rear end of the hindfoot section of the foot; and the pull strap is fastened to the rearward section where the rearward section is positioned to lie adjacent the hindfoot section of the foot at the rear end of the hindfoot section of the foot.

In at least one embodiment, the pull strap is permanently fastened to the rearward section with thread.

In at least one embodiment, the foot holder further comprises a central section, comprising an adjustable length loop, positioned to encircle the forefoot section and/or the midfoot section of the foot; and the rearward section extends around the hindfoot section of the foot and is fastened to the central section at a position to lie adjacent an inner side and at a position to lie adjacent an outer side of the foot.

In at least one embodiment, the rearward section is permanently or releasably fastened to the central section at the positions to lie adjacent the inner side and at the position to lie adjacent the outer side of the foot with thread.

In at least one embodiment, the foot holder further comprises a toe region section, comprising a loop, positioned to encircle a toe region of the forefoot section of the foot; and the loop includes a ring through which the pull strap passes through.

In at least one embodiment, the strap guide comprises a closed annular ring.

In at least one embodiment, the closed annular ring is a D-ring.

FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1A:
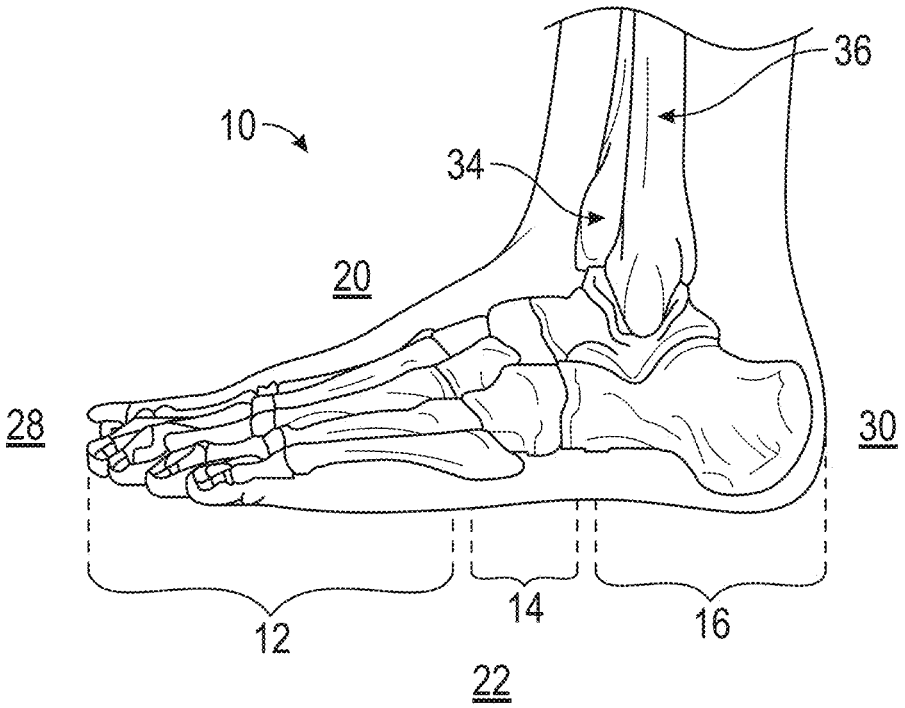
FIG. 1A is an outer (lateral) side view of a human foot.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Throughout the present description, like reference numerals and letters indicate corresponding structure throughout the several views, and such corresponding structure need not be separately discussed. Furthermore, any particular feature(s) of a particular exemplary embodiment may be equally applied to any other exemplary embodiment(s) of this specification as suitable. In other words, features between the various exemplary embodiments described herein are interchangeable as suitable, and not exclusive.

Figure 1B:
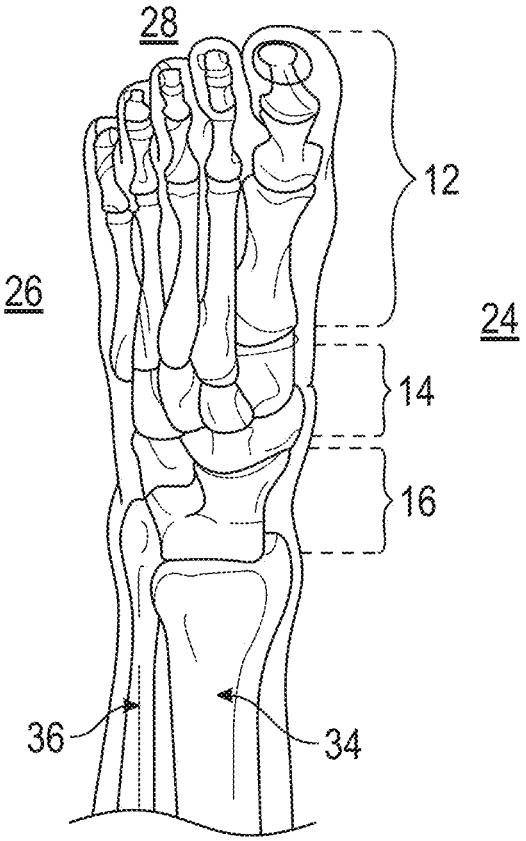
FIG. 1B is a top (dorsal) side view of the human foot of FIG. 1A.

Referring now to FIG. 1A and FIG. 1B, there is shown a human foot 10. The bone structure of the foot 10 may be divided into three sections, which may be referred to as the forefoot section 12, the midfoot section 14 (which includes the arch) and the hindfoot section 16 (which includes the heel).

The forefoot section 12 contains the bones of the five phalanges (toes) and the five metatarsal bones, respectively for each of the phalanges, which are each joined at a metatarsophalangeal (MTP) joint, respectively. The forefoot section 12 meets the midfoot section 14 at the five tarsometatarsal (TMT) joints, which may also be referred to as the Lisfranc's joints.

The midfoot section 14 contains five irregularly-shaped bones called the tarsals, which form the arch of the foot 10. The tarsals may be referred to as the navicular, cuboid, and medial, intermediate, and lateral cuneiforms.

The hindfoot section 16 contains two large bones, which may be referred to as the talus and the calcaneus. The calcaneus forms the heel of the foot, while the talus rests on top of the calcaneus and forms the pivoting joint of the ankle and connects with the tibia 34 and fibula 36 of the leg.

As shown, foot 10 has a top side (dorsal aspect) 20; bottom side (planum aspect or sole) 22; inner side (medial aspect) 24; outer side (lateral aspect) 26; front end (anterior aspect) 28; and rear end (posterior aspect) 30.

Figure 2A:
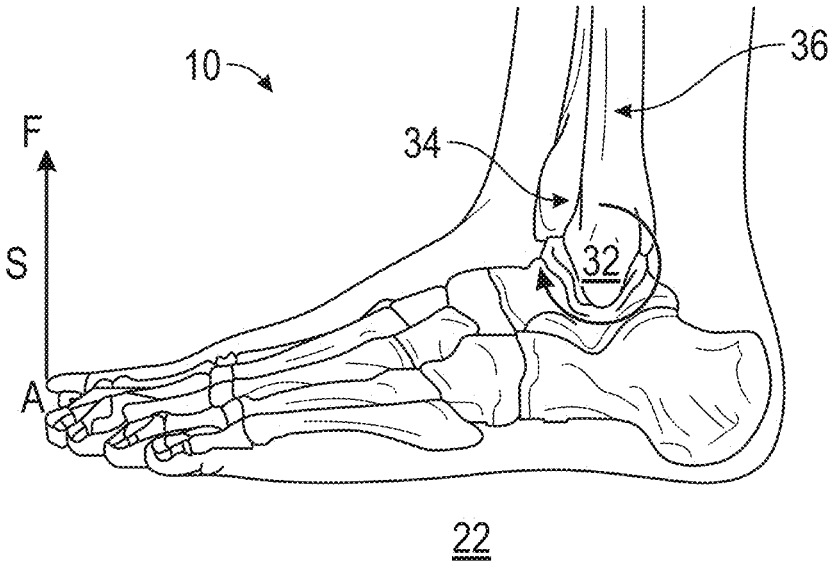
FIG. 2A (Prior Art)
FIG. 2A is an outer (lateral) side view of the human foot of FIG. 1A, with an illustration of force applied to the foot in a known manner.

Referring now to FIG. 2A, there is shown a side view of the human foot 10 with an illustration of a force F applied to the foot. As shown, the force F is applied to a strap S arranged substantially perpendicular to the bottom side 22 of the foot 10, which is connected to an anchor A located adjacent the distal end of the phalanges. In such a manner, it may be understood that the foot 10 will rotate superior (towards the head) about ankle joint 32, which may also be referred to as dorsiflexion of the foot 10 (i.e. flexion of the foot upwards closer to the shin). During dorsiflexion of the foot 10, via rotation of the ankle joint 32, the Achilles tendon may be brought into tension. However, the plantar fascia may not come into tension unless the phalanges similarly rotate upwards via rotation of the metatarsophalangeal (MTP) joints.

Figure 2B:
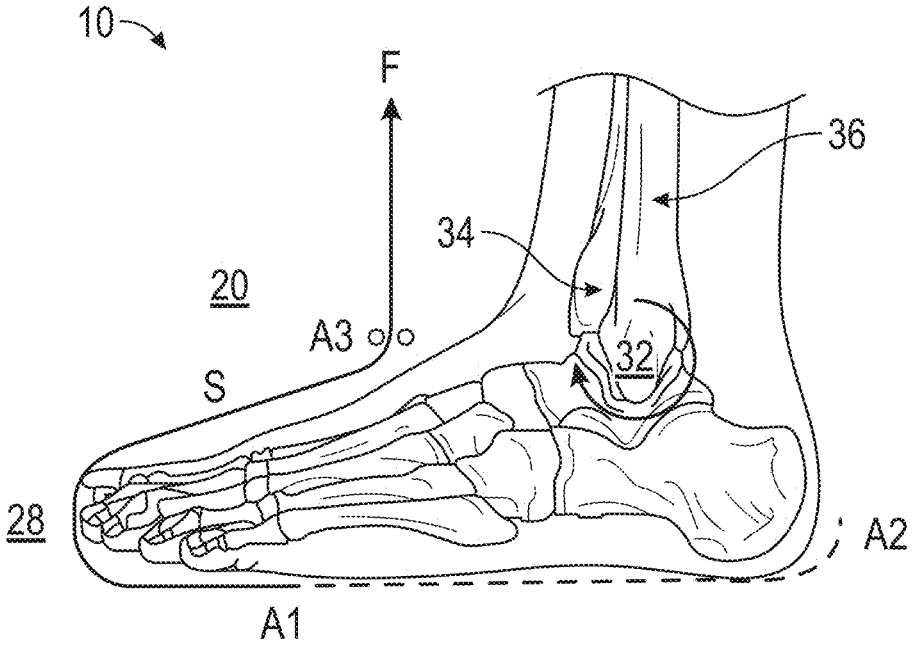
FIG. 2B is an outer (lateral) side view of the human foot of FIG. 1, with an illustration of force applied to the foot using an exercise apparatus according to the present disclosure.

Referring now to FIG. 2B, the exercise apparatus of the present disclosure aims to move the force F generally applied perpendicular to the bottom side 22 of the foot 10 from the anchor A located adjacent the distal end of the phalanges (FIG. 2A) to an anchor ring/loop A3 overlying adjacent a mid-region of the top side 20 of the foot 10 (FIG. 2B).

During use of the exercise apparatus, from an anchor A1 disposed underlying/adjacent the bottom side 22 of the foot 10 or an anchor A2 disposed adjacent the rear end 30 (heel) of the foot 10 (or anywhere in between), the force F, when applied to the strap S, may be transmitted from the anchor A1/A2, along the bottom side 22 of the foot 10 (substantially parallel to the longitudinal length/bottom side 22 of the foot 10) in a direction anterior (towards the front of the foot 10). From a location beneath the metatarsals, the force F may be further transmitted anteriorly along the bottom side 22 of the foot 10 towards the front end 28 of the foot 10, and may wrap to the top side 20 of the foot 10, where it is then transmitted posteriorly along the top side 20 of the foot 10 to the anchor ring/loop A3. In such manner, when the force F is applied to the strap S, the exercise apparatus is used to assist dorsiflexion of the foot 10, particularly to stretch the plantar fascia and Achilles tendon simultaneously and more effectively.

Figure 3A:
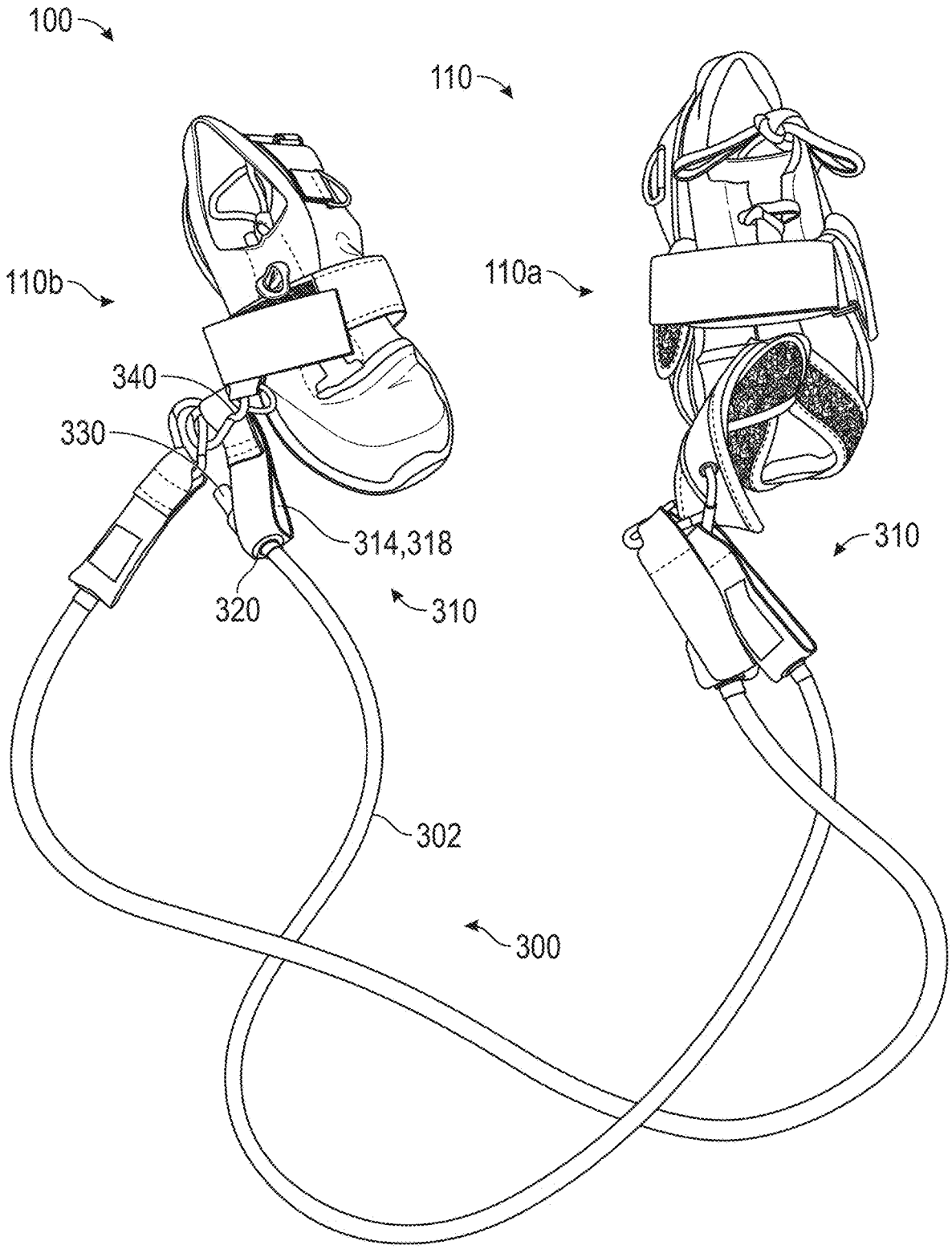
FIG. 3A is a perspective view of an exercise apparatus, with a foot-to-foot tether, according to the present disclosure.

Referring now to FIG. 3A, there is shown an exemplary embodiment of an exercise apparatus 100 according to the present disclosure. As shown, exercise apparatus 100 comprises two foot holders 110, particularly a left foot holder 110*a* and a right foot holder 110*b*, which are releasably connected to at least one elongated tether 300 at the terminal ends thereof, i.e. with each foot holder 110*a*, 110*b* being located at one of the ends of the connecting tether 300, respectively.

Connecting tether 300 may comprise at least one connecting line 302, having a coupling 310 disposed adjacent each end to connect to left foot holder 110*a* and a right foot holder 110*b*. As shown, coupling 310 may comprise a strap 314 in the form of a permanently closed, fixed length loop 318, which may be permanently closed by thread stitching. An anchor 330 fixed adjacent each end of the line 302 may extend through a metal annular ring 320 (e.g. grommet) in the strap 314 and be prevented from being pulled through or otherwise removed through the grommet 320 via mechanical interference, while simultaneously providing a permanent, 360 degree swivel connection therebetween.

The coupling 310 may also further comprise a releasably fastenable fastener 340. As shown, releasably fastenable fastener 340 may be a carabiner, which may also be referred to as a snap hook, snap link, or spring snap. A carabiner may be understood to be an openable/closable metal ring/loop, which is made openable/closable by a spring-loaded gate.

As shown in FIG. 3A, the releasably fastenable fastener 340 at one and of the connecting tether 300 extends through the enclosed (window) openings 224 (see FIG. 4*k*) disposed in the middle of the width of each forward (pull strap) section 200 of the foot holder 110.

Turning to FIGS. 4A-4L, foot holders 110 are preferably of like construction, it being understood that the left foot holder 110*a* being of like construction as the right foot holder 110*b*, except for the opposite foot designation. Foot holder 110*b* is shown to have certain components thereof removed as compared to foot holder 110*a*, particularly to facilitate understanding. However, it should be understood that with the following description, while only one foot holder 110 is described, particularly left foot holder 110*a*, it should be understood the description applied equally to both the right foot holder 110*b* and the left foot holder 110*a*.

Referring now to FIGS. 4A-4L, foot holder 110 overlies and holds foot 10 when contained therein. More particularly, foot holder 110 comprises a foot harness 120, which may be configured to overlie and releasably retain not only foot 10 therein, but also a shoe 40 disposed on the foot 10, which may be provided as part of the apparatus 100. As shown, shoe 40 may be any suitable athletic shoe, e.g. running, training and walking shoes; court shoes, trail shoes, cross trainers, and sneakers. Foot harness 120 itself in the present embodiment is not a shoe 40, particularly as it does not have a sole to tread on.

As shown, the foot holder 110, and more particularly foot harness 120, may comprise a rearward (strap) section 122, which comprises an elongated strap body 123 and overlies the inner side 24, rear end 30 and outer side 26 of the hindfoot section 16 (forming a U-shape) of foot 10, as well the inner side 24 and outer side 26 of the midfoot section 14 of foot 10 and at least a portion of the inner side 24 and outer side 26 of the forefoot section 12 of foot 10.

The foot holder 110, and more particularly foot harness 120, may further comprise a central (strap) section 134 (which may also be referred to as a middle or intermediate section), which comprises an elongated strap body 135 and forms an adjustable length, closeable/openable enclosed foot loop 136 which, depending on width, overlies/encircles around the top side 20, inner side 24, bottom side 22 and outer side 26 of the midfoot section 14 of foot 10, and/or the proximal forefoot section 12 of the foot 10, particularly at a proximal end region of the metatarsals, and more particularly the base and/or proximal shaft region of the metatarsals. As such, it should also be understood that the central (strap) section 134 may overlie/encircle the tarso metatarsal joints.

Figure 4A:
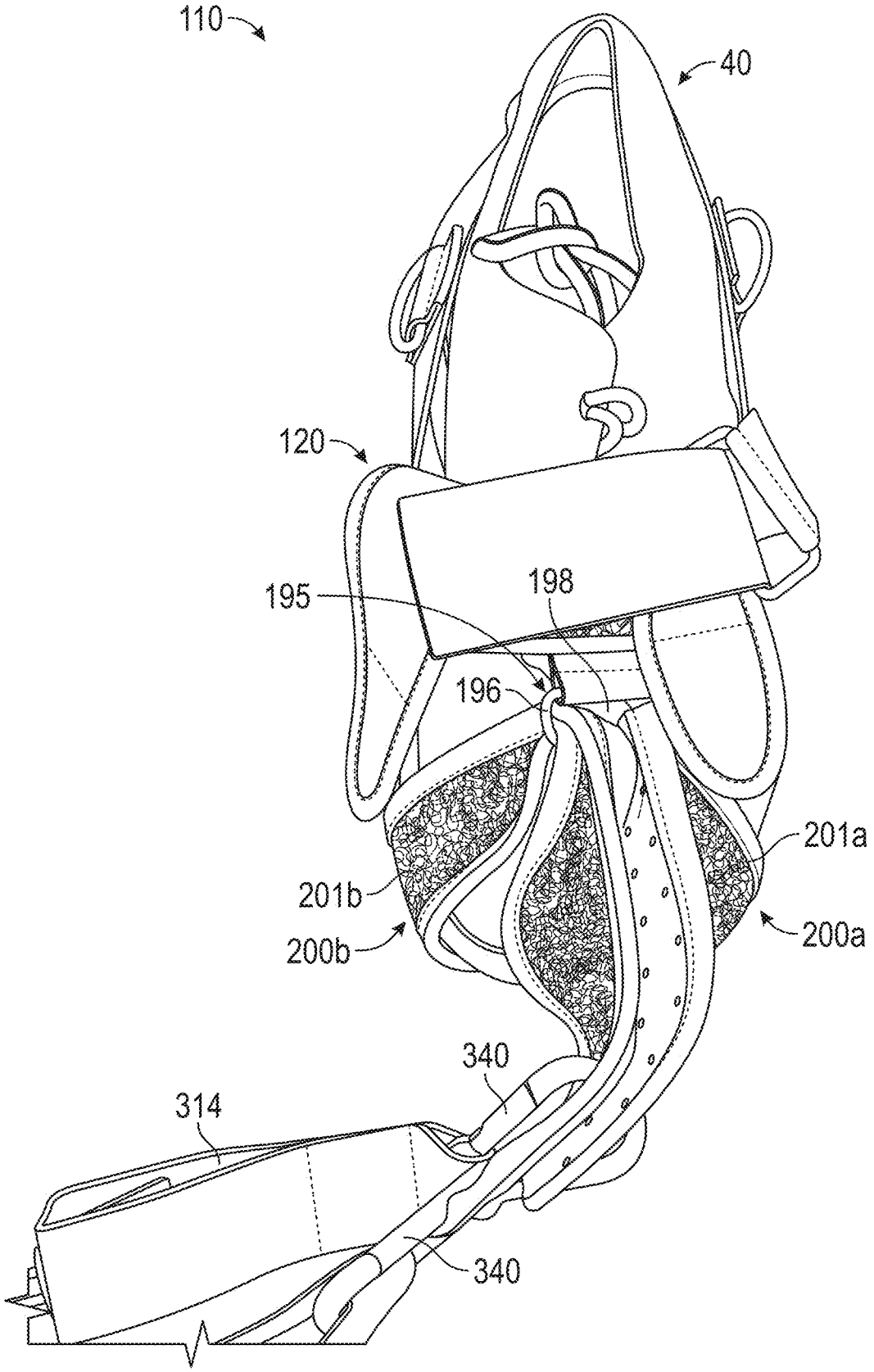
FIG. 4A is a top (dorsal) perspective view of a (right) foot holder of the exercise apparatus of FIG. 3A.
Figure 4B:
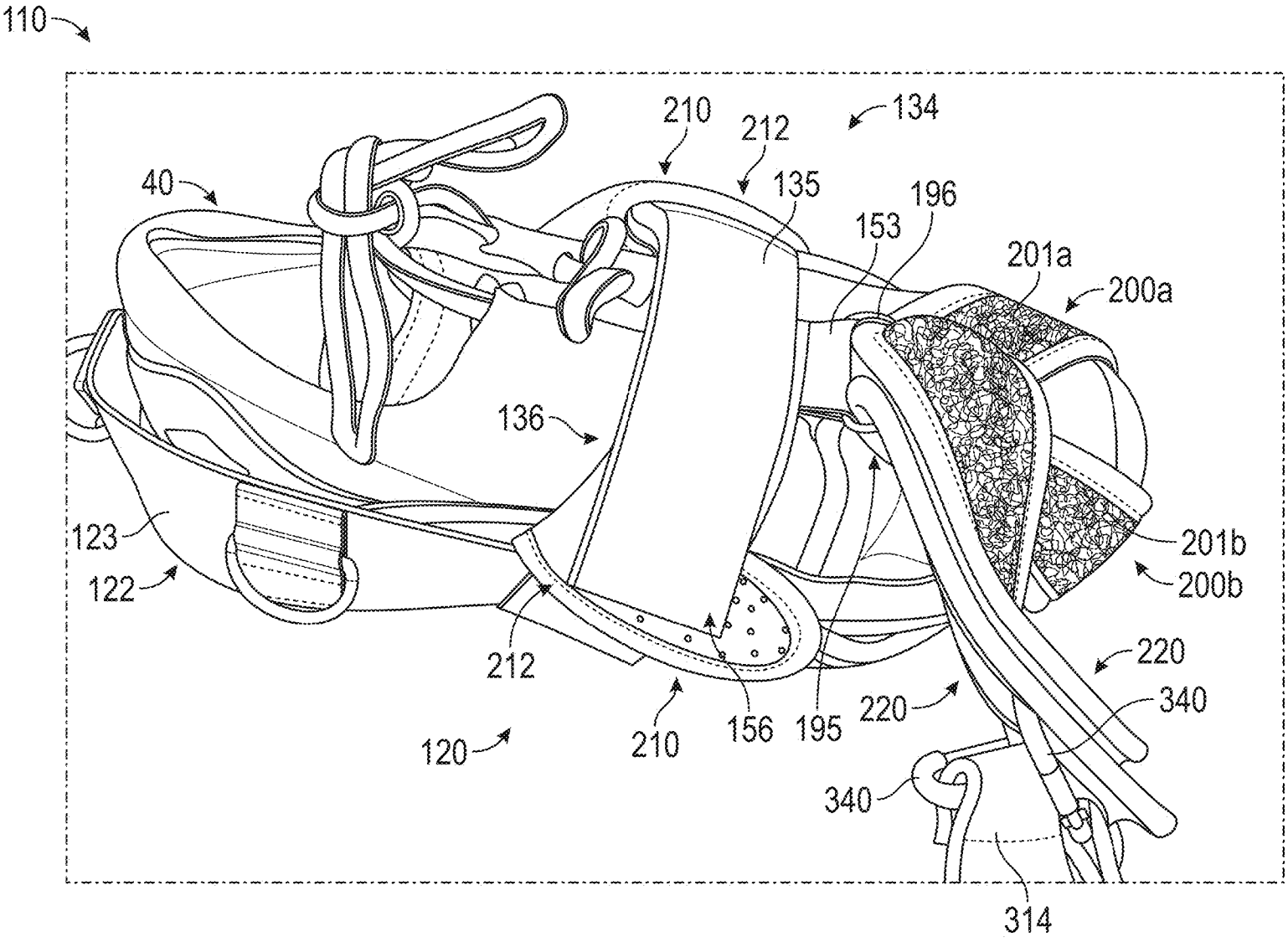
FIG. 4B is an inner (medial) perspective view of the foot holder of FIG. 4A.
Figure 4C:
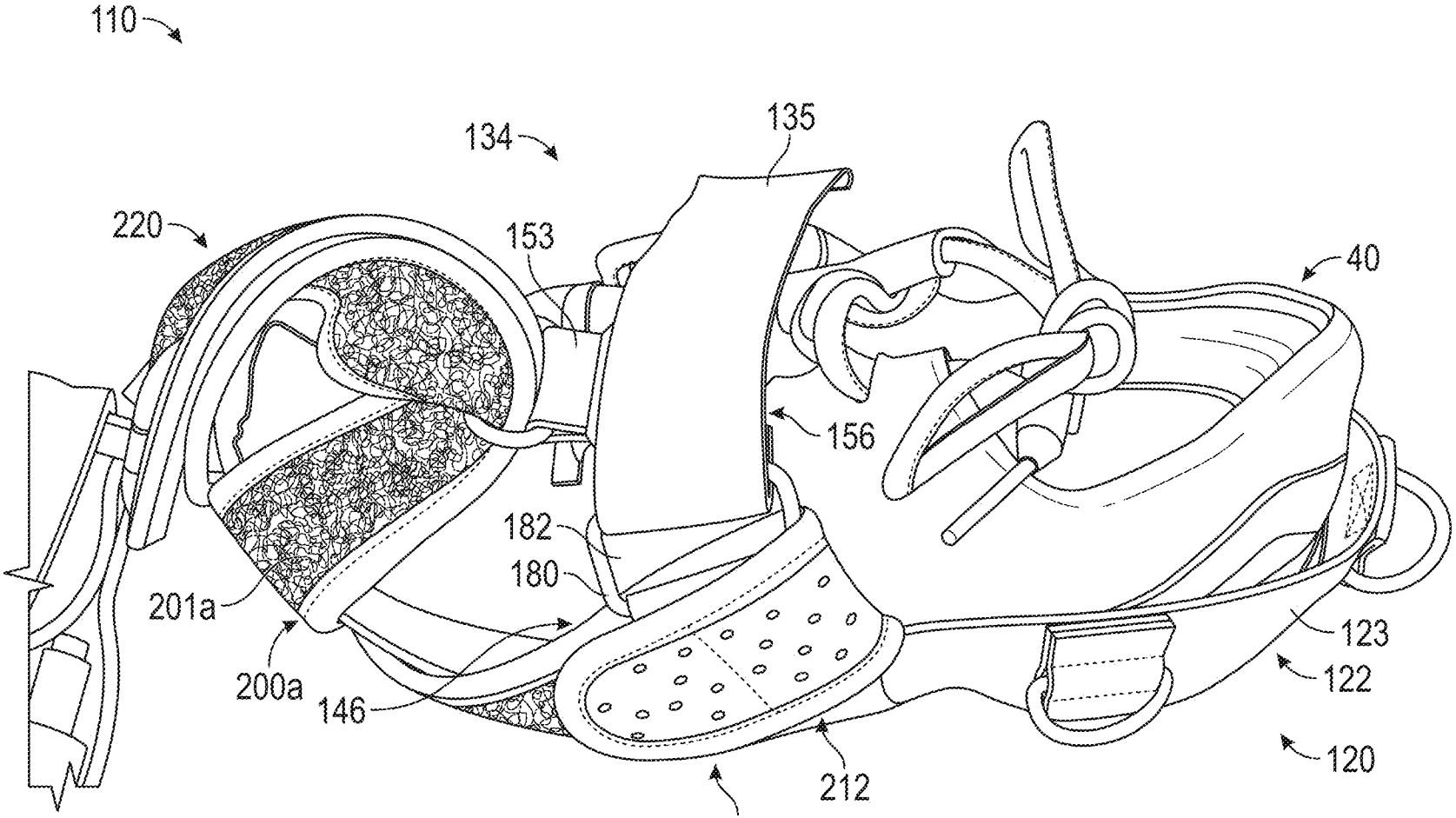
FIG. 4C is an outer (lateral) perspective view of the foot holder of FIG. 4A.
Figure 4D:
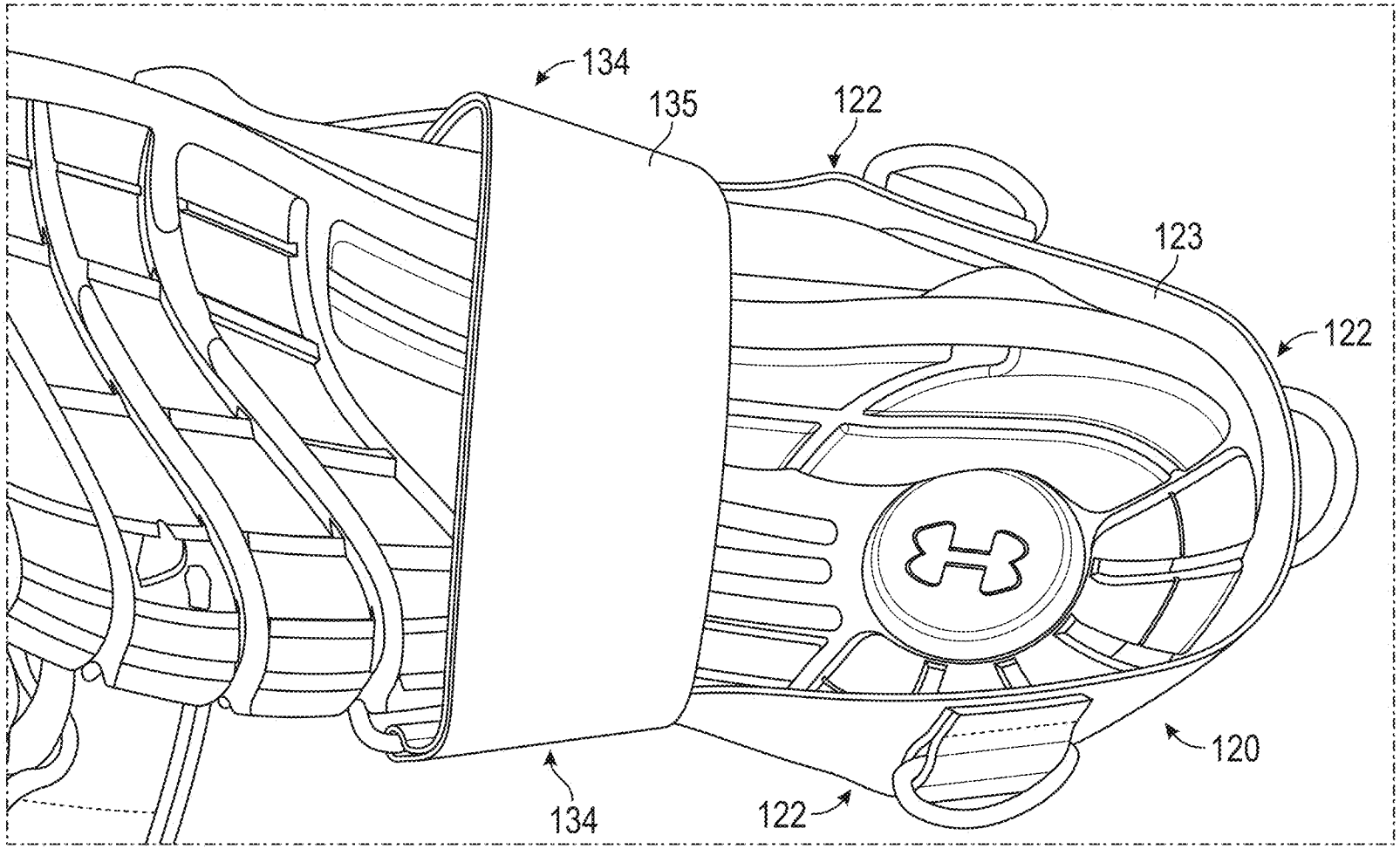
FIG. 4D is a bottom (planum) perspective view of the foot holder of FIG. 4A.
Figure 4E:
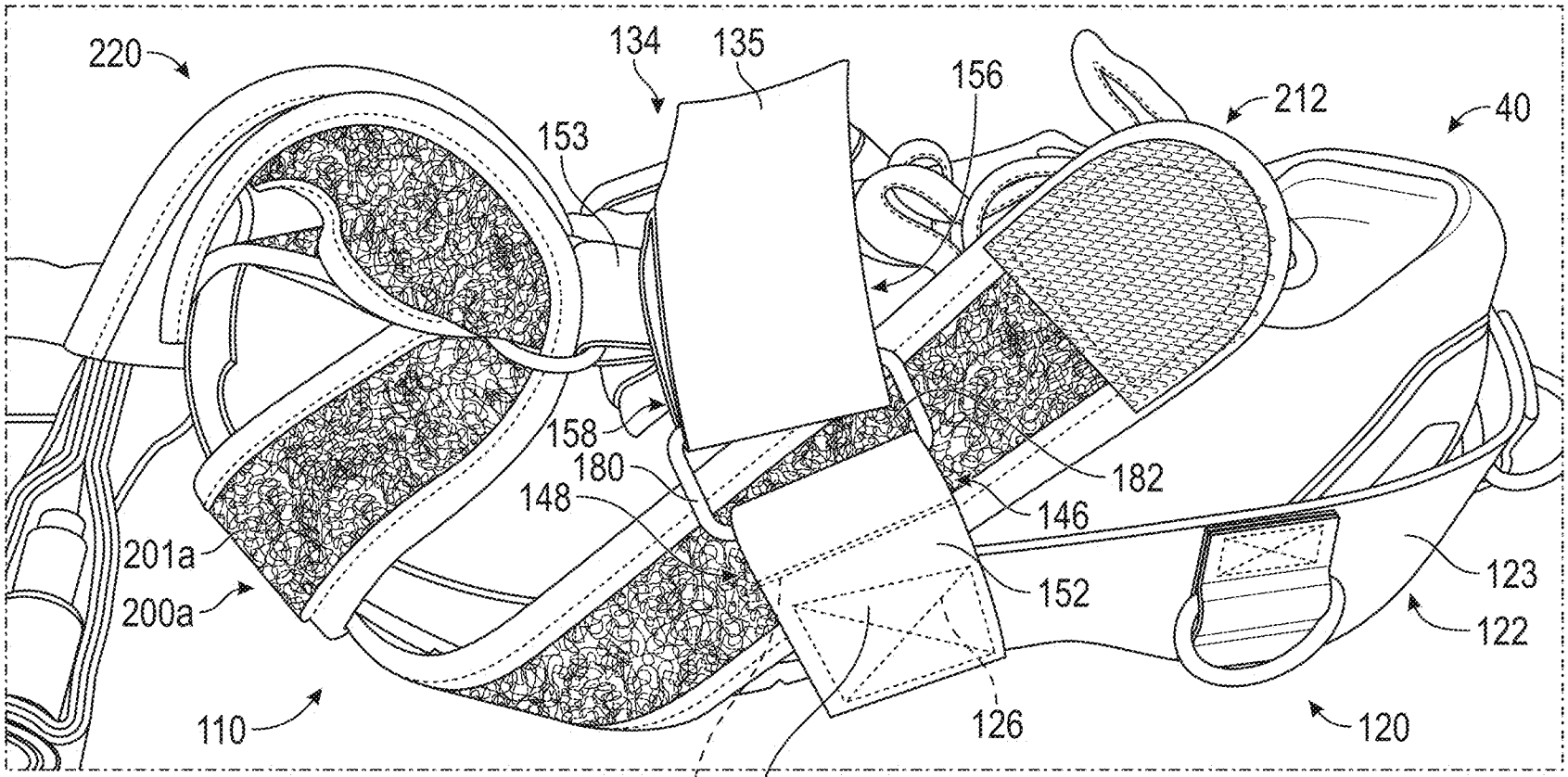
FIG. 4E is another outer (lateral) perspective view of the foot holder of FIG. 4A.
Figure 4F:
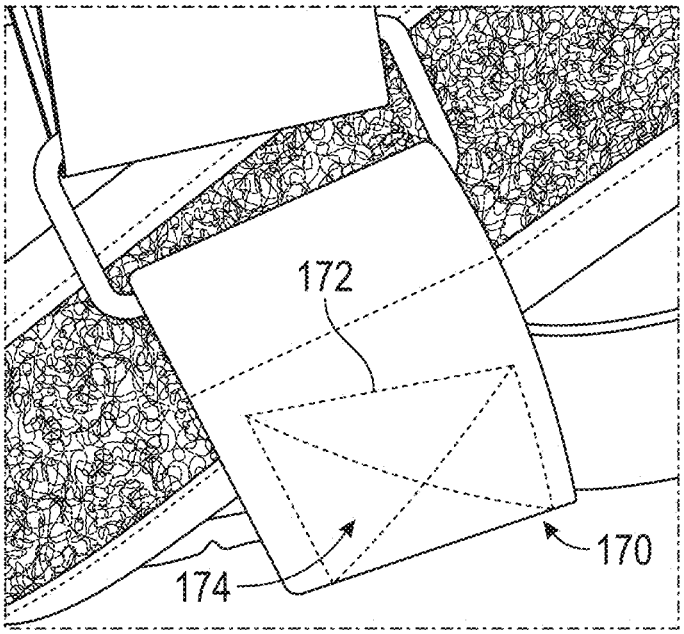
FIG. 4F is a close-up outer (lateral) perspective view of a portion of the foot holder of FIG. 4E.
Figure 4H:
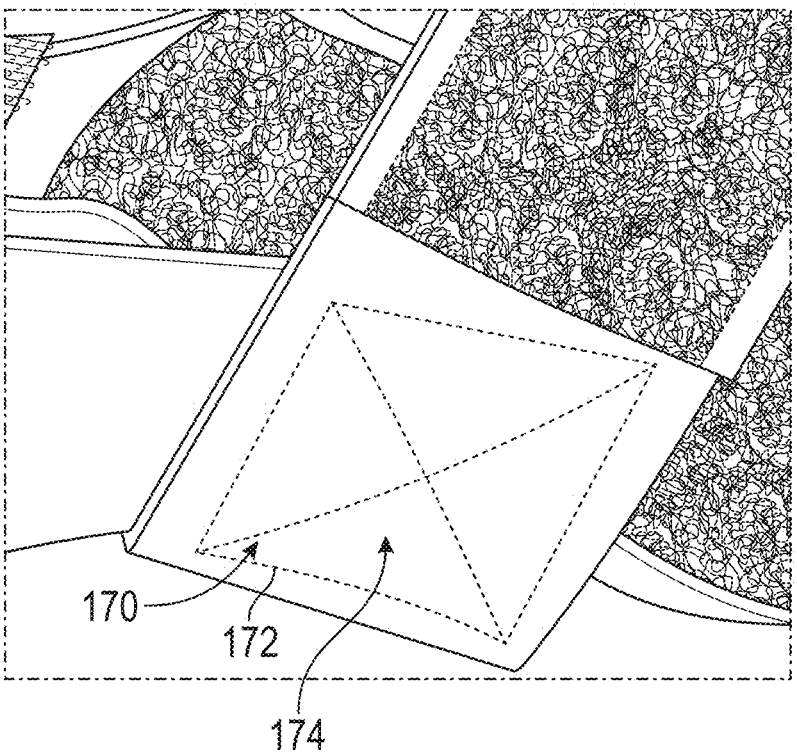
FIG. 4H is a close-up inner (medial) perspective view of a portion of the foot holder of FIG. 4G.
Figure 4G:
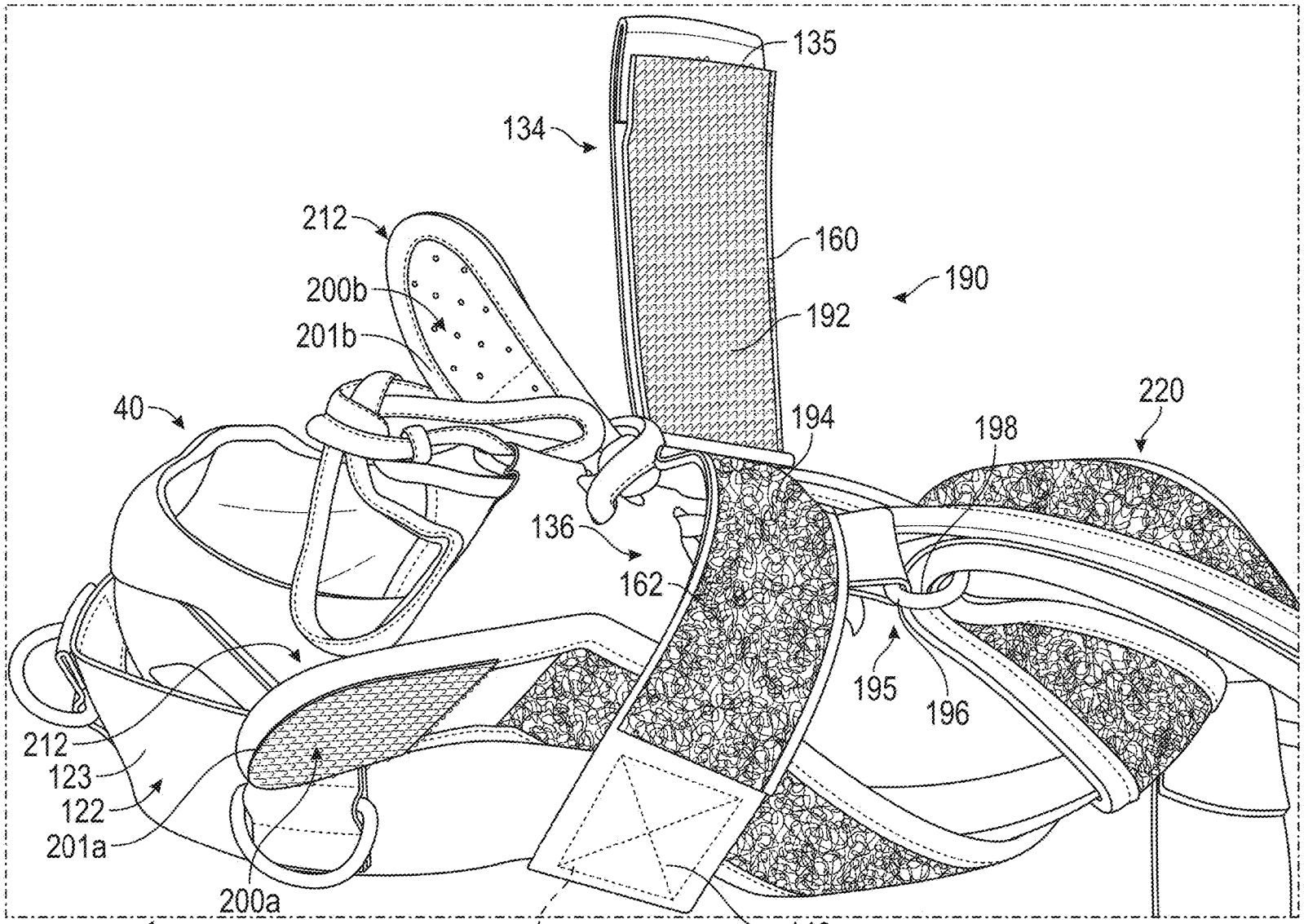
FIG. 4G is another inner (medial) perspective view of the foot holder of FIG. 4A.
Figure 4I:
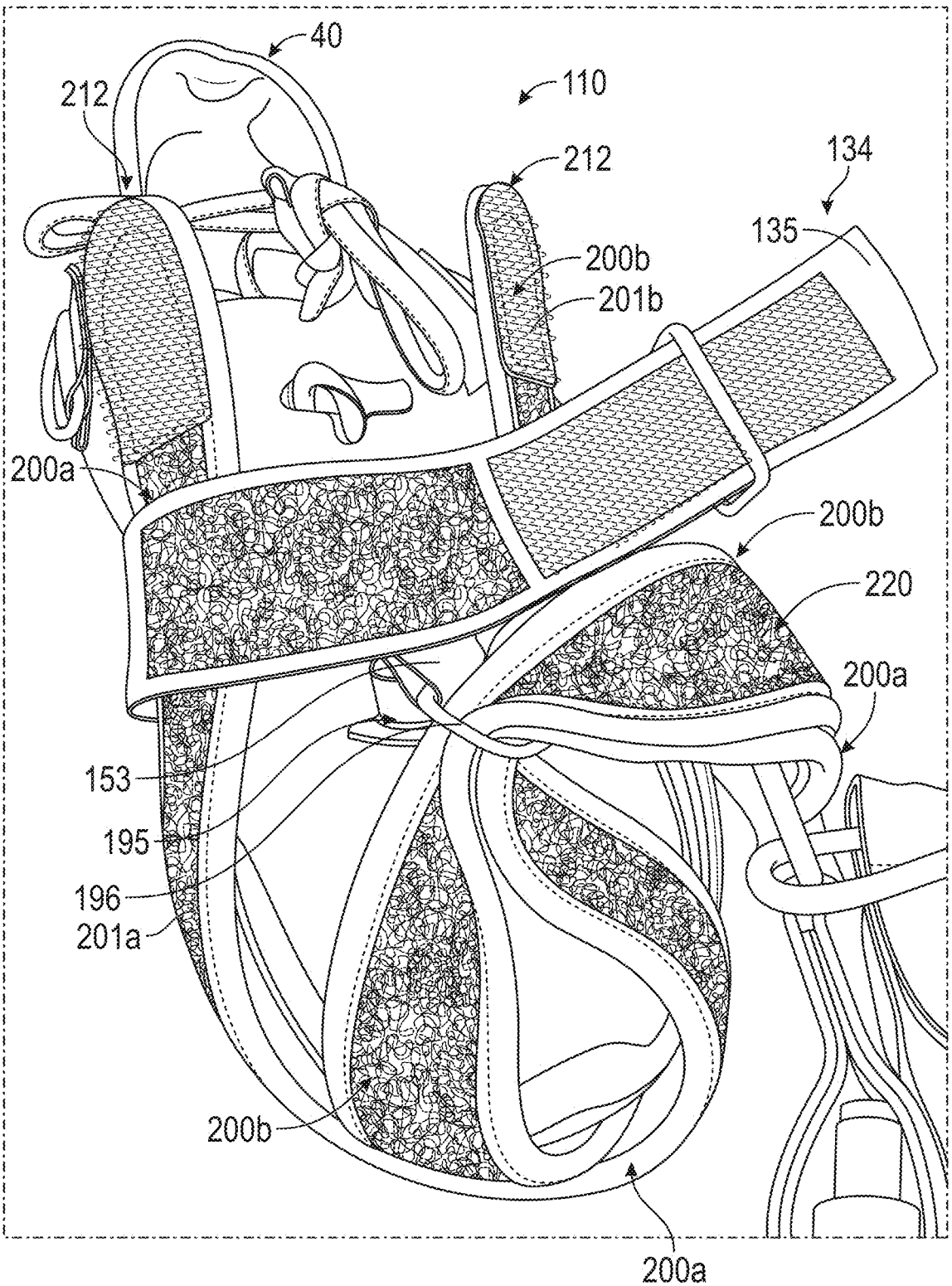
FIG. 4I is another top (dorsal) perspective view of the foot holder of FIG. 4A.
Figure 4J:
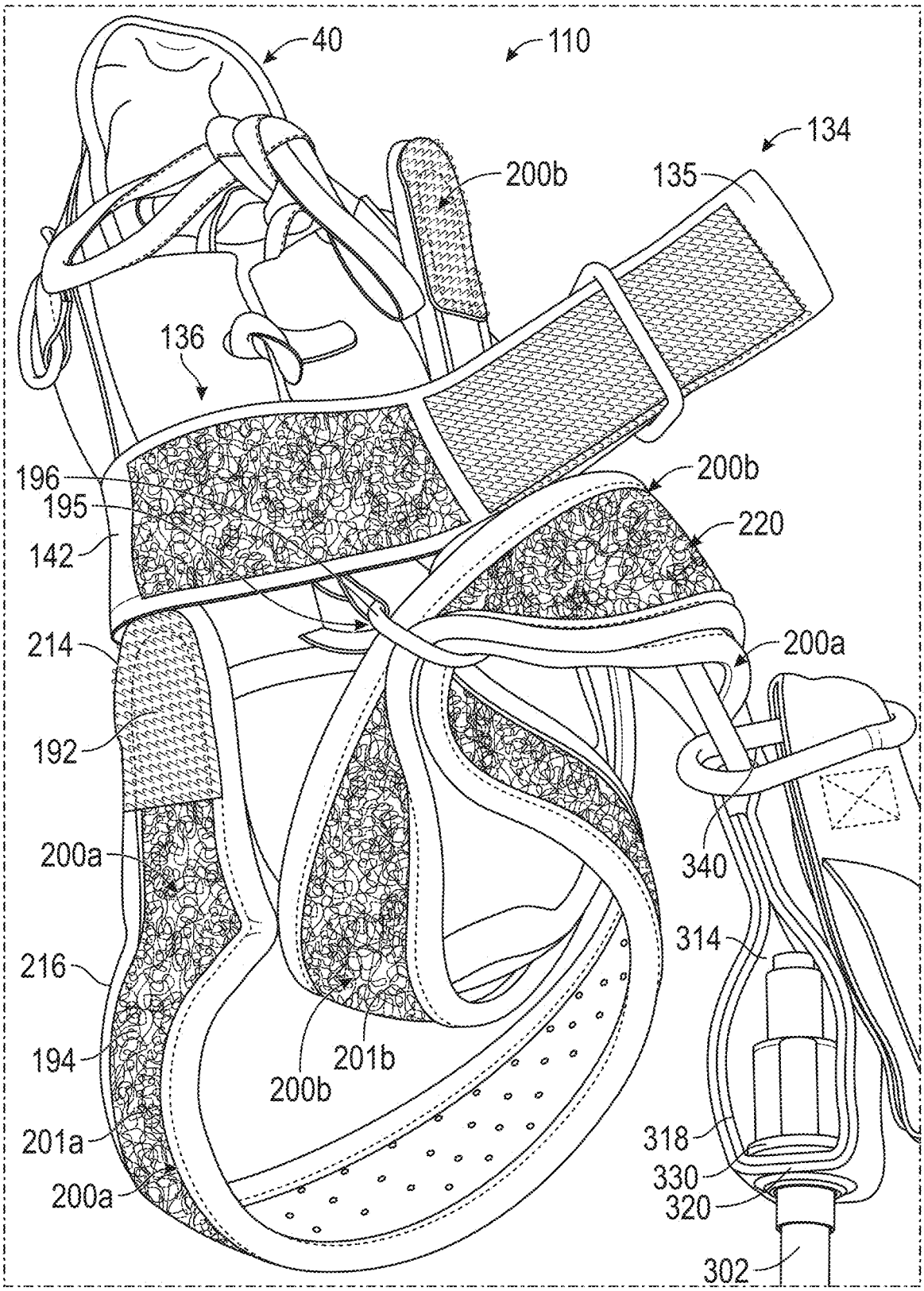
FIG. 4J is another top (dorsal) perspective view of the foot holder of FIG. 4A.

Referring now to FIGS. 4E and 4G, the rearward (strap) section 122 and the central (strap) section 134 may be disposed in a layered relationship at the inner side 24 and outer side 26 of the forefoot section 12 and/or the midfoot section 14 of the foot 10, particularly by opposing end portions, and more particularly by a first (medial) end portion 124 (see FIG. 4G) and a second (lateral) end portion 126 (see FIG. 4E), of the rearward (strap) section 122 each being permanently or releasably affixed to a medial side portion 142 (see FIG. 4G) and a lateral side portion 144 (see FIG. 4E) of central (strap) section 134 at the medial side 24 and the lateral side 26, respectively, of the forefoot section 12 and/or midfoot section 14 of foot 10.

Referring to FIGS. 4F and 4H, the rearward (strap) section 122 and the central (strap) section 134 may be permanently affixed to one another at the medial side 24 (see FIG. 4H) and the lateral side 26 (see FIG. 4F), respectively, of the forefoot section 12 and/or midfoot section 14 of the foot 10, by a fastener 170, particularly a permanent (non-detachable) fastener, which may comprise sewing thread stitches 172 provided by a plurality of rows of thread stitching 174. In other embodiments, the rearward (strap) section 122 and the central (strap) section 134 may be releasably affixed to one another at the medial side 24 (see FIG. 4H) and the lateral side 26 (see FIG. 4F), respectively, of the forefoot section 12 and/or midfoot section 14 of the foot 10, by a fastener 170, particularly a releasable fastener, which may comprise a hook-an-loop fastener, such as Velcro brand look-and-loop fastener, described further herein.

Referring to FIGS. 4C and 4E, a first loop 146 is disposed at a first (lateral) end 148 of the central (strap) section 134, which may be considered the lateral end loop of the central (strap) section 134, and a second loop 156 is disposed at a second (medial) end 158 of the central (strap) section 134, which may be considered the medial end loop of the central (strap) section 134.

As best shown by FIG. 4E, first loop 146 may be a permanently closed, fixed length loop, which may be particularly formed by folding a first end portion 150 of the central (strap) section 134 back onto an adjacent portion 152 of the central (strap) section 134 and permanently stitching the first end portion 150 and the adjacent portion 152 to one another with thread to form the first loop 146. In a particular embodiment, the adjacent portion 152 of the central (strap) section 134 may also be the lateral side portion 144 of the central strap 140. In such case, the sewing thread stitches 172 may extend through 3 layers, particularly (1) the first end portion 150 of the central (strap) section 134, (2) the adjacent portion 152/lateral side portion 144 of central (strap) section 134 and (3) the rearward (strap) section 122, to permanently affix all three layers together. Even more particularly, the first end portion 150 of the central (strap) section 134 may be disposed between the adjacent portion 152/lateral side portion 144 of central (strap) section 134 and the rearward (strap) section 122.

As shown by FIGS. 4C and 4E, first loop 146 may provide an anchor loop of fixed length for a plastic or metal annular ring/loop 180 through which the first loop 146 extends. As shown, the annular ring/loop 180 may be a closed rectangular ring/loop having an opening 182 through which first end portion 150 is extended through before the first loop 146 is sewn closed.

Referring to FIGS. 4E and 4G, second loop 156 may be particularly formed by folding a second end portion 160 of the central (strap) section 134 back onto an adjacent portion 162 of the central (strap) section 134 in similar fashion to first loop 146. However, second loop 156 may include a releasably fastenable fastener 190 such that the loop 156 is an openable/closeable, adjustable length loop. More particularly, second end portion 160 may include a first releasable fastener member 192 and adjacent portion 162 may include a second releasable fastener member 194, which may both be held by thread stitches 172 to their strap portions 160, 162, respectively. Releasably fastenable fastener 190 may be a hook-and-loop fastener (e.g. Velcro brand hook-and-loop fastener). First releasable fastener member 192 may be the hook fastener member and second releasable fastener 194 may be the loop fastener member, or vice-versa, which may be understood to be mating fastener members.

While in an open state, the second end portion 160 may be extended through opening 182 of annular ring/loop 180 and then folded back on the adjacent portion 162 such that the first releasable fastener member 192 and the second releasable fastener member 194 connect to close the adjustable length loop 156. In the foregoing manner, the foot loop 136 may also be closed to form a closed loop which secures around the forefoot section 12 and/or the midfoot section 14 of foot 10. The size (diameter) of the foot loop 136 maybe increased or decreased to accommodate different foot sizes by adjusting the size of adjustable length loop 156. When the length of second end portion 160 folded back on the adjacent portion 162 is increased, the size of foot loop 136 decreases while the size of the adjustable length loop 156 increases, or vice-versa.

As shown, the second end portion 160 and the adjacent portion 162 of the central (strap) section 134 may be long enough to overlie the top side 20 of the forefoot section 12 of foot 10, and hence may also be referred to as the top or dorsal portions 160, 162 of central (strap) section 134.

As shown throughout FIGS. 4A-4L, the leading or front edge of the adjacent, or dorsal portion 162 of central (strap) section 134, includes a strap guide 195 coupled thereto in a form of a plastic or metal annular (ring/eyelet) anchor 196, which is held in a sewn closed fixed length strap guide anchor loop 153, in a similar manner to ring 180. More particularly, anchor loop 153 may be formed by folding (strap) end portion 154 (e.g. see FIG. 4R) of the anchor loop 153 onto adjacent (strap) portion 155 (e.g. see FIG. 4R) of the anchor loop 153 and thread stitching such to the central (strap) section 134. As shown, annular (ring/eyelet) anchor 196 is shown as a D-ring, which is used in conjunction with a pair of forward (pull strap) sections 200*a*, 200*b*, which each comprise an elongated strap body 201*a*, 201*b*, and are explained in greater detail below. As shown, annular (ring/eyelet) anchor 196 may be disposed mid-region of the top side 20 (both medial-lateral and anterior-posterior) of the foot 10 as to overlie the top side 20 of the forefoot section 12 and/or the midfoot section 14. Preferably, the annular (ring/eyelet) anchor 196 overlies the top side 20 of the forefoot section 12, and even more preferably, overlies the top side 20 of the forefoot section 12 at a location between and including the second and fourth metatarsals at a proximal end region thereof.

Forward (pull strap) section 200*a* is connected to medial side portion 142 of central (strap) section 134, while forward (pull strap) section 200*b* is connected to lateral side portion 144 of central (strap) section 134. Both forward (pull strap) sections 200*a*, 200*b* are preferably of like construction, it being understood that forward (pull strap) section 200*a* being of like construction as the forward (pull strap) section 200*b*, except for their relative positions. Hence, reference will be made to forward (pull strap) section 200 below, it being understood the description to apply equally to both forward (pull strap) sections 200*a*, 200*b*. Reference will be made to forward (pull strap) sections 200*a*, 200*b* when such concerns the relative positions thereof.

As shown by FIG. 4B, each forward (pull strap) section 200, i.e. 200*a*, 200*b*, has a first loop 210 disposed at a first end 212 of the forward (pull strap) section 200. First loop 210 may be particularly formed by folding a first end portion 214 of the forward (pull strap) section 200 back onto an adjacent portion 216 of the forward (pull strap) section 200. Similar to loop 156, first loop 210 may include a releasably fastenable fastener 190 such that the first loop 210 is an openable/closeable, adjustable length loop. More particularly, first end portion 214 may include a first releasable fastener member 192 and adjacent portion 216 may include a second releasable fastener member 194, which may both be held by thread stitches 172 to their strap portions 214, 216, respectively. Releasably fastenable fastener 190 may be a hook-and-loop fastener (e.g. Velcro brand hook-and-loop fastener). First releasable fastener member 192 may be the hook fastener member and second releasable fastener 194 may be the loop fastener member, or vice-versa.

In alternative embodiments, first loop 210 may be a permanently closed, fixed length loop, which may be particularly formed by folding the first end portion 214 of the forward (pull strap) section 200 back onto the adjacent portion 216 of the forward (pull strap) section 200 and permanently stitching (e.g. stitches 172) the first end portion 214 and the adjacent portion 216 to one another with thread to form the first loop 210.

When the first loop 210 of each forward (pull strap) section 200 is closed, first loop 210 of forward (pull strap) section 200*a* contains medial side portion 142 of central (strap) section 134 therein, while first loop 210 of forward (pull strap) section 200*b* contains lateral side portion 144 of central (strap) section 134 therein. If the first end portion 214 and the adjacent portion 216 are permanently fastened together, such as by thread stitches 172, the thread stitches 172 may also extend through the medial side portion 142 of central (strap) section 134 and the lateral side portion 144 of central (strap) section 134, respectively. Alternatively, in such instance, each loop 210 may be eliminated, and the first end portion 214 of the forward (pull strap) section 200 may be permanently fastened, such as by thread stitches 172, to the medial side portion 142 of central (strap) section 134 and the lateral side portion 144 of central (strap) section 134, respectively.

From the medial side portion 142 of central (strap) section 134, the forefoot (pull strap) section 200*a* while extending anterior, wraps from the inner side 24 of foot 10 to the bottom side 22 of foot 10 (particularly at the forefoot section 12 and more particularly adjacent the first metatarsal) and extends laterally under the bottom side 22 from the inner side 24 to the outer side 26 and then wraps from the bottom side 22 to the outer side 26 of foot 10 (particularly at the forefoot section 12 and more particularly adjacent the fourth and/or fifth phalanx), and thereafter extends posterior and medial to the mid-region of the top side 20 (both medial-lateral and anterior-posterior) of the foot 10 where it extends through the opening 198 of annular (ring/eyelet) anchor 196.

From the lateral side portion 144 of central (strap) section 134, the forefoot (pull strap) section 200*b* while extending anterior, wraps from the outer side 26 of foot 10 to the bottom side 22 of foot 10 (particularly at the forefoot section 12 and more particularly adjacent the fifth metatarsal) and extends medially under the bottom side 22 from the outer side 26 to the inner side 24 and then wraps from the bottom side 22 to the inner side 24 of foot 10 (particularly at the forefoot section 12 and more particularly adjacent the first phalanx, i.e. the big/great toe), and thereafter extends posterior and lateral to the mid-region of the top side 20 (both medial-lateral and anterior-posterior) where it extends through the opening 198 of annular (ring/eyelet) anchor 196.

Figure 4K:
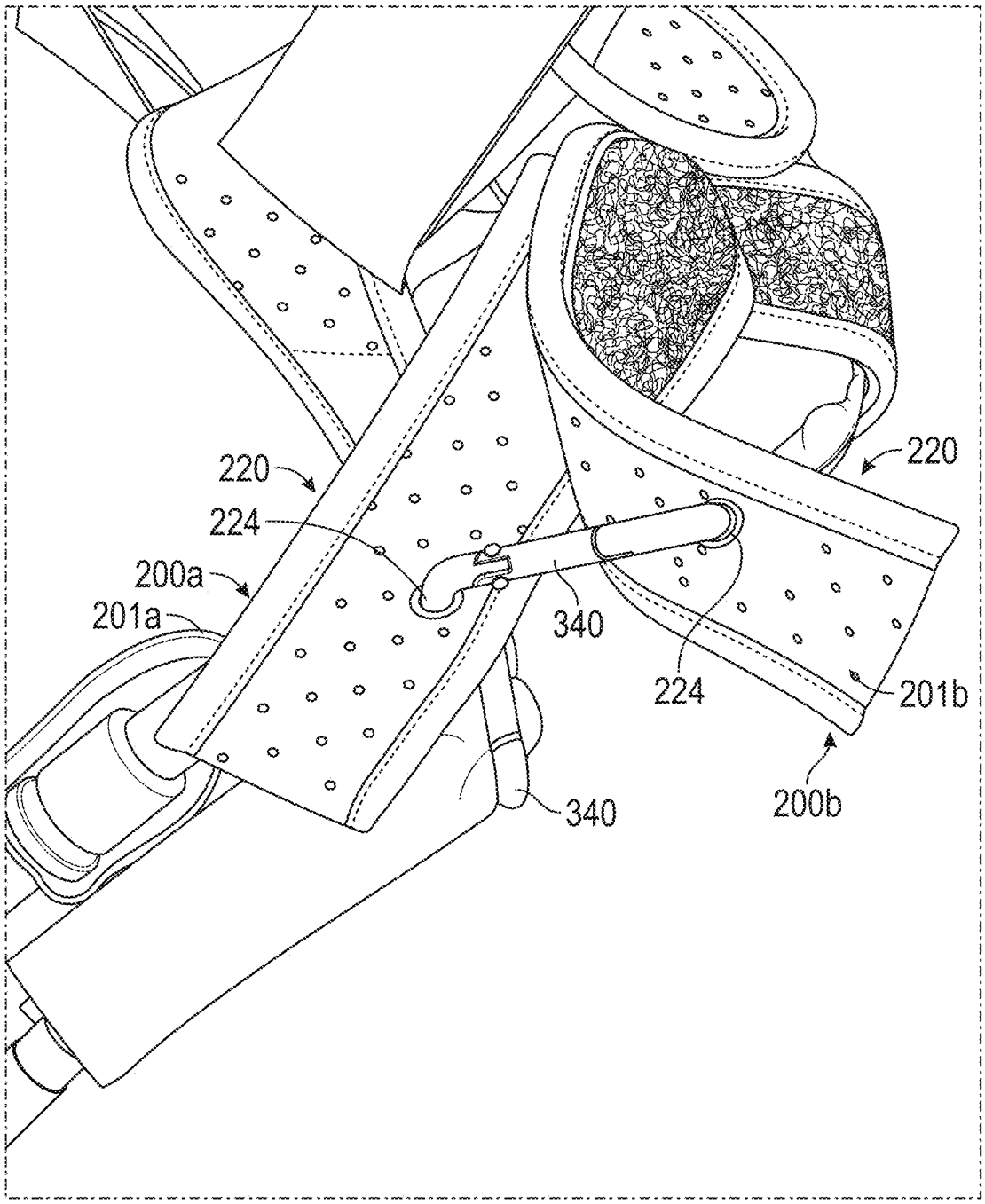
FIG. 4K is a close-up top (dorsal) perspective view of a portion of the foot holder of FIG. 4J.
Figure 4L:
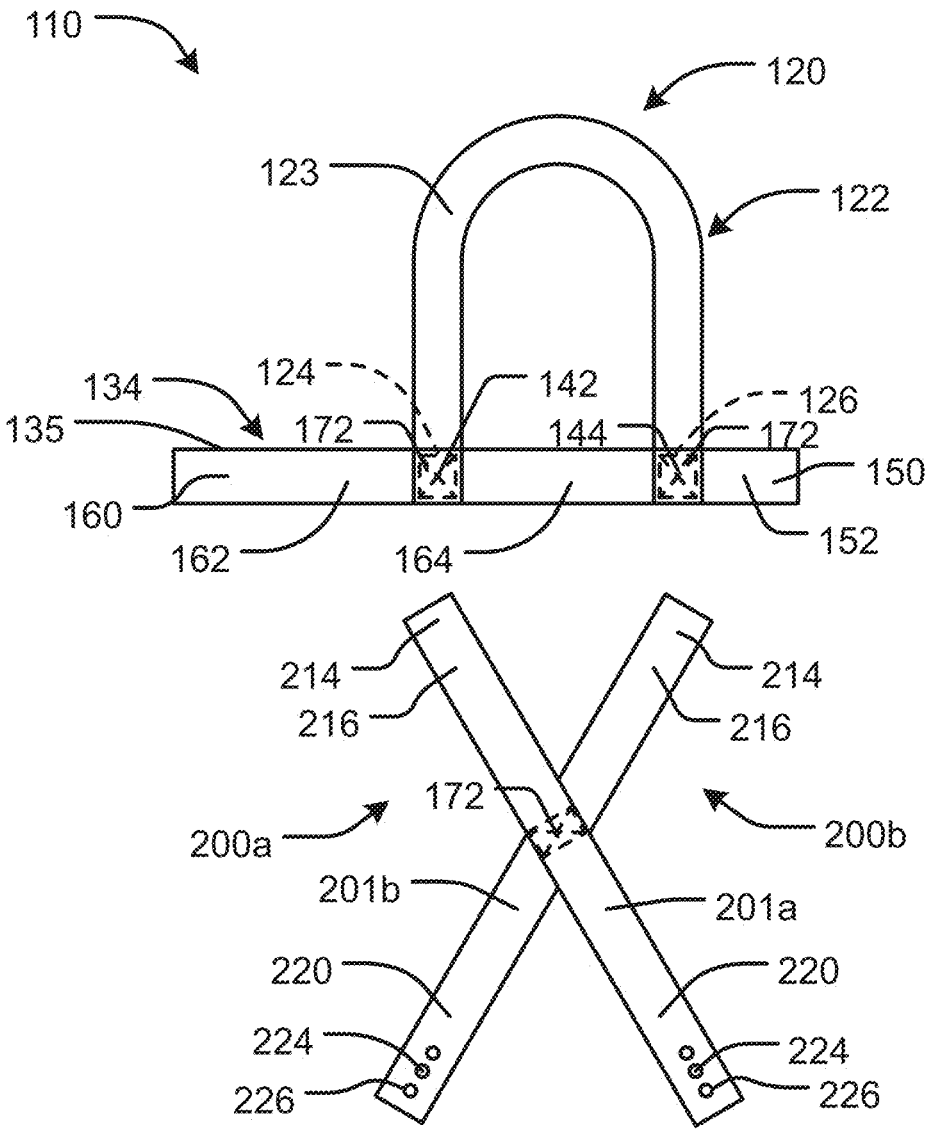
FIG. 4L is a top view of the straps of the foot holder of FIG. 4A.
Figure 4O:
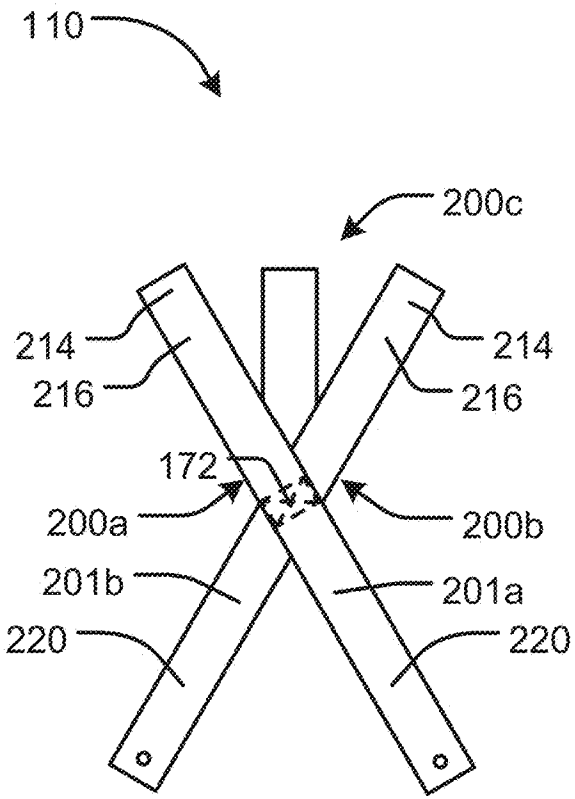
FIG. 4O is a top view of the straps for another embodiment of the foot holder of FIG. 4A.
Figure 4N:
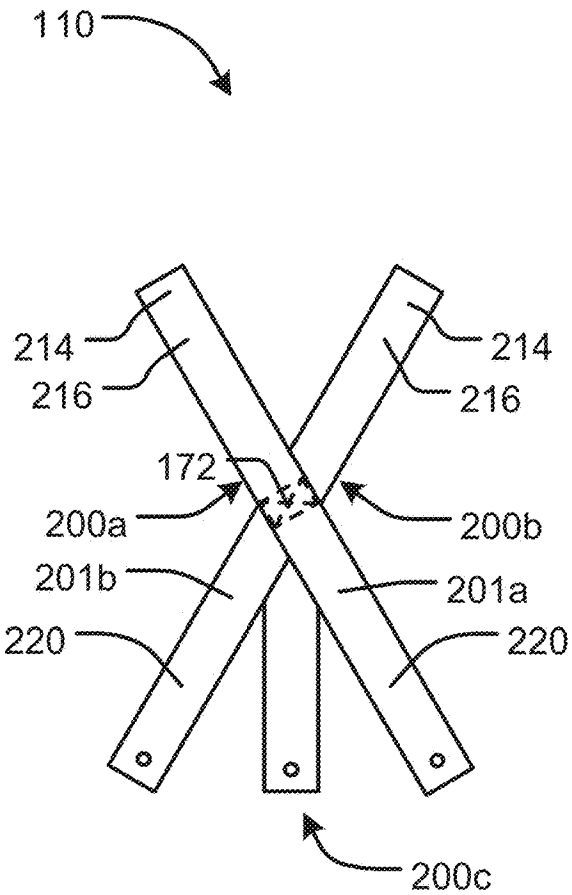
FIG. 4N is a top view of the straps for another embodiment of the foot holder of FIG. 4A.

As shown by FIGS. 4K and 4L, at the second end portion 220 of each forward (pull strap) section 200 (which extends through opening 198 of annular (ring/eyelet) anchor 196 is at least one opening 224 disposed in the middle of the width of the forward (pull strap) section 200. As shown by FIG. 4L, each second end portion 220 of each forward (pull strap) section 200 may include a row of openings, and each opening 224 may be defined by a plastic or metal annular ring 226, such as a grommet (See FIG. 4R for greater detail).

FIG. 4L shows a plan view of the rearward (strap) section 122, central (strap) 134, and forward straps 200*a*, 200*b* of the foot holder 110 after being stitched together with thread, but before incorporation of the fasteners and rings. As shown, forefoot (pull strap) section 200*a* and forefoot (pull strap) section 200*b* may be permanently affixed to one another where they cross one another at the bottom side 22 of foot 10, particularly by a permanent (non-detachable) fastener 170, which may comprise sewing thread stitches 172 provided by a plurality of rows of thread stitching 174.

Figure 4M:
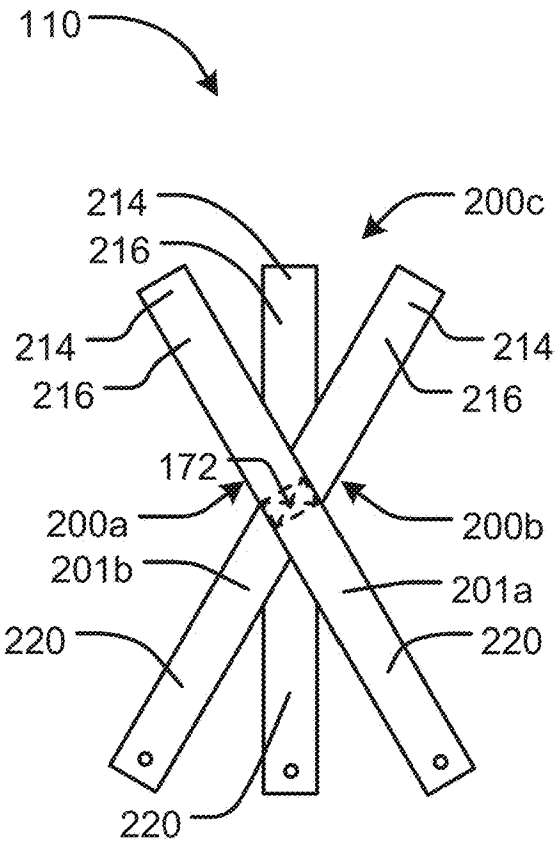
FIG. 4M is a top view of the straps for another embodiment of the foot holder of FIG. 4A.
Figure 4Q:
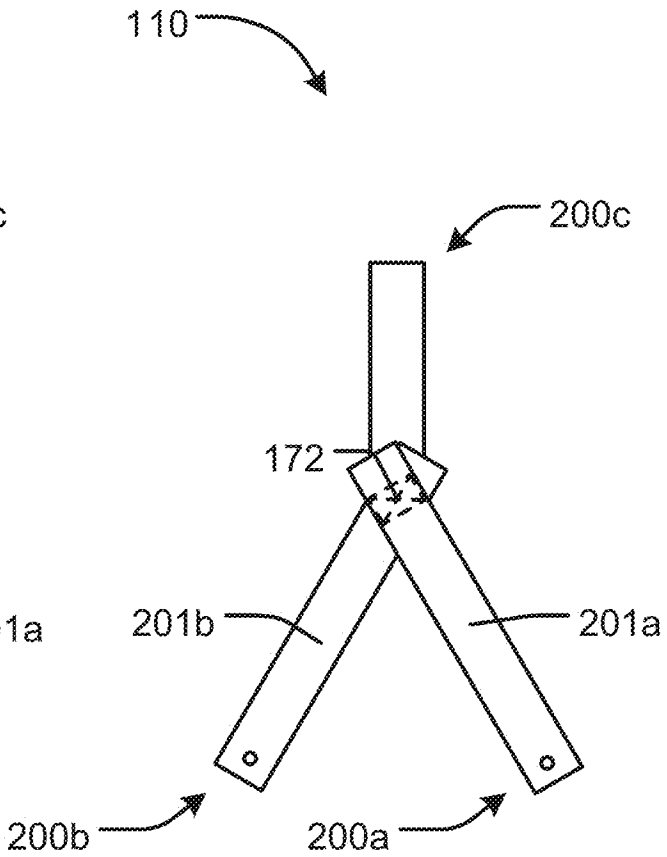
FIG. 4Q is a top view of the straps for another embodiment of the foot holder of FIG. 4A.
Figure 4P:
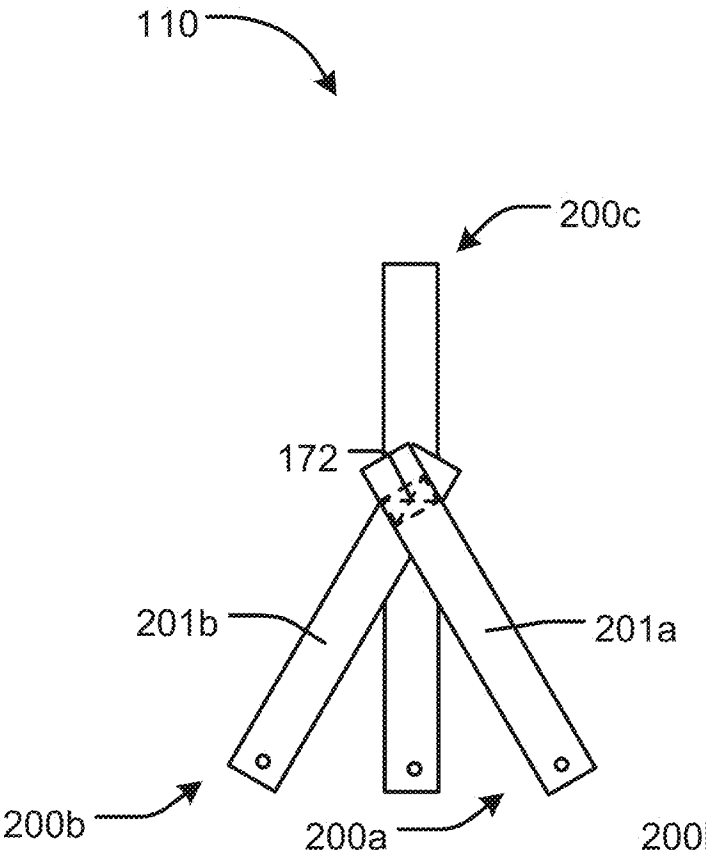
FIG. 4P is a top view of the straps for another embodiment of the foot holder of FIG. 4A.

FIGS. 4M-4R show alternative strap constructions for foot holder 100. In FIG. 4M, a third forward (pull strap) section 200*c* is incorporated into the foot folder 100. Forward (pull strap) section 200*c* may similarly include a first loop 210 formed by folding a first end portion 214 of the forward (pull strap) section 200*c* back onto an adjacent portion 216 of the forward (pull strap) section 200*c*, which contains an intermediate portion 164 (disposed at bottom side 22 of foot 10) of central (strap) section 134. First loop 210 of forward (pull strap) section 200*c* may be permanently closed (e.g. thread stitches) or openable/closeable (e.g. Velcro brand hook-and-loop fastener) in a same manner as forward (pull strap) section 200*a* and/or 200*b*. Also similar to forward (pull strap) sections 200*a*, 200*b*, forward (pull strap) section 200*c* is fastened to the central strap 134, extends underneath the bottom side of foot 10, wraps around the second and/or third phalanx from the bottom side 22 to the top side 20 of the foot 10 and thereafter extends posterior to the mid-region of the top side 20 of the foot 10 where it extends through the opening 198 of annular (ring/eyelet) anchor 196.

In the embodiments of FIGS. 4N-4Q, various segments of the forward (pull strap) sections 200*a*, 200*b*, and 200*c* may be eliminated on contrast to the configuration of FIG. 4M.

The straps of foot holder 110 may be formed of fibers, particularly being a woven (solid weave) fabric, such as a planar or tubular webbing, particularly of a synthetic, polymer material. Exemplary materials may comprise, essentially consist of or consist of thermoplastic nylon (polyamide), polyester and polypropylene alone or in combination. Other materials may include natural materials such as hemp, cotton or flax (linen).

Webbing may include polypropylene, cotton infused with nylon and abrasion resistant nylon webbing. The webbing may have a width of 10-25 millimeters, such as 10 mm, 15 mm, 20 mm and 25 mm. The webbing may have a thickness of 0.5-2.5 mm, such as 0.5 mm, 1 mm, 1.5 mm, 2 mm and 2.5 mm.

The straps of foot holder 110 may be formed of a band, such as an elastomeric (e.g. rubber) band, which may be used alone or in combination with woven straps. The bands used for the various straps may have a same or different resistance to elongation.

Figure 4R:
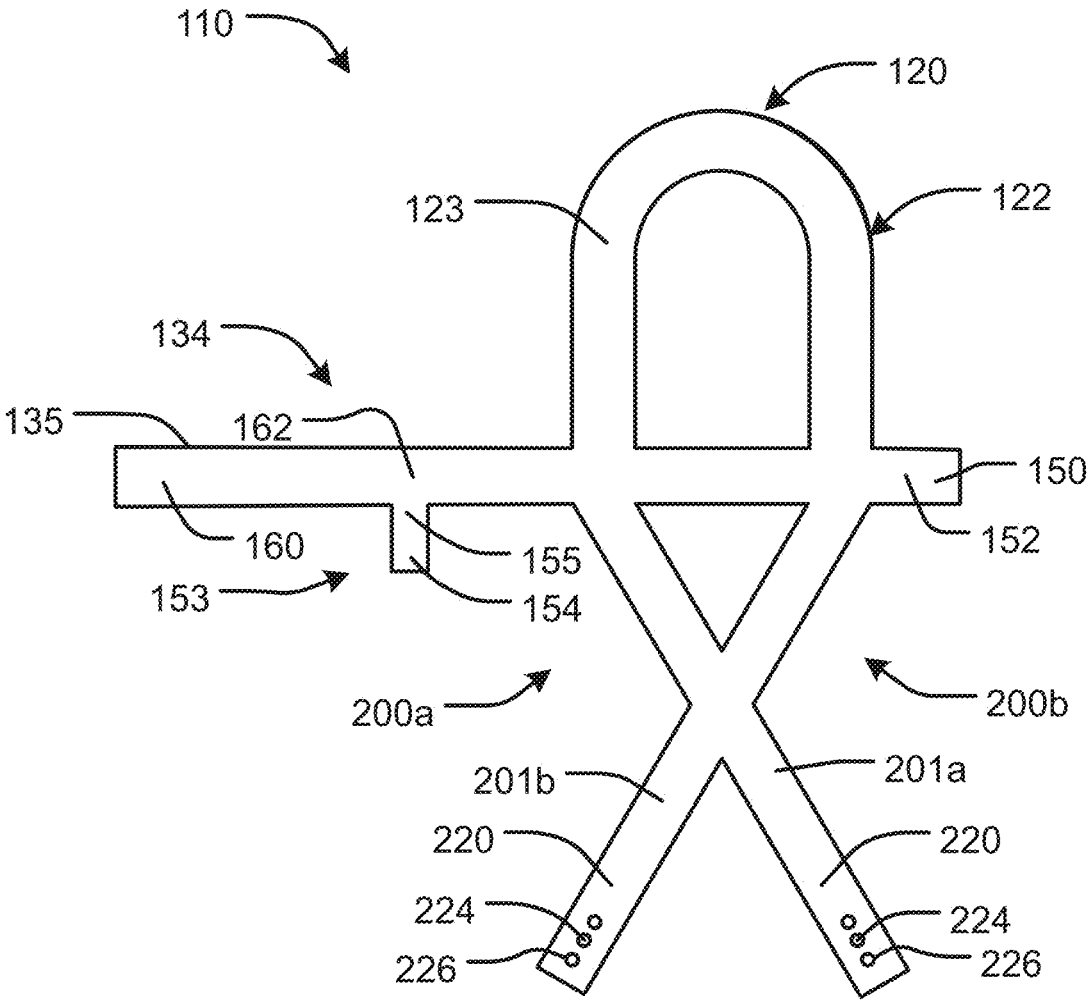
FIG. 4R is a top view of the straps for another embodiment of the foot holder of FIG. 4A.

In FIG. 4R, the individual straps are no longer fastened by thread stitches 172, as having been eliminated, particularly as the foot holder 100 is formed as a one-piece plastic body which may be more particularly be formed as an injection molded body. More particularly, the injection molded body may be formed of an elastomeric polymer composition, such as a thermoplastic elastomeric polymer composition.

As used herein, an elastomeric polymer composition may include any composition with a glass transition temperature Tg below room temperature and which is at most, 50% crystalline (i.e., the material contains an amorphous phase of 50% or greater, up to 100% amorphous phase). The elastomeric polymer composition may also be characterized as a material that has an elongation at 23° C. of at least 100%, and which, after being stretched to twice its original length and being held at such for one minute, may recover in a range of 50% to 100% within one minute after release from the stress. More particularly, the elastomeric polymer composition may recover in a range of 75% to 100% within one minute after release from the stress, and even more particularly recover in a range of 90% to 100% within one minute after release from the stress.

Exemplary elastomeric polymer compositions may particularly include elastomers, particularly styrene block polymers, such as styrene block copolymers (e.g. styrene-butadiene copolymer) and styrene block terpolymers (e.g. styrene-butadiene-styrene terpolymer, styrene-ethylene-butylene-styrene terpolymer, styrene-ethylene/propylene-styrene terpolymer); polyolefin blends (e.g. polypropylene and ethylene-propylene-diene monomer rubber, polypropylene and nitrile rubber, ethylene-propylene rubber); elastomeric alloys such as melt-processable rubbers and thermoplastic vulcanizates; polyolefins; polyurethanes; polyesters;

and rubbers such as natural rubber, neoprene rubber, acrylic rubber, butadiene rubber, butyl rubber, ethylene-propylene rubber, ethylene propylene diene monomer rubber, fluorocarbon rubber, isoprene rubber, nitrile rubber, polyurethane rubber and silicone rubber.

Ring 180 may be connected by extending the first end portion 150 through opening 182 before the first loop 146 is closed. Similar to the earlier embodiments, first loop 146 may be a permanently closed, fixed length loop, which may be particularly formed by folding a first end portion 150 of the central (strap) section 134 back onto an adjacent portion 152 of the central (strap) section 134. However, in addition to, or rather than, permanently stitching the first end portion 150 and the adjacent portion 152 to one another with thread to form the first loop 146, the first end portion 150 and the adjacent portion 152 may be adhesively (thermally) bonded, particularly by welding (e.g. ultrasonic, vibration), heat-staking, or hot plate joining.

Annular (ring/eyelet) anchor 196 may be connected by extending the end portion 154 through opening 198 before the anchor loop 153 is closed. Anchor loop 153 may be a permanently closed, fixed length loop, which may be particularly formed by folding an end portion 154 back onto an adjacent portion 155. However, in addition to, or rather than, permanently stitching the end portion 154 and the adjacent portion 155 to one another with thread to form the anchor loop 153, the end portion 154 and the adjacent portion 155 may be adhesively (thermally) bonded, particularly by welding (e.g. ultrasonic, vibration), heat-staking, or hot plate joining.

The first releasable fastener member 192 in the form of a hook fastener member and the second releasable fastener member 194 in the form of a loop fastener member, or vice-versa, may be attached to the central (strap) section 134 by being adhesively (thermally) bonded, particularly by welding (e.g. ultrasonic, vibration), heat-staking, or hot plate joining in addition to or as an alternative to thread stitching.

Referring now to FIGS. 5A-5E, there is shown another exercise apparatus 100 comprising a foot holder 110 according to the present disclosure.

As shown, the foot holder 110 includes the rearward (strap) section 122 and central (strap) section 134, including the strap guide 195/annular (ring/eyelet) anchor 196, of earlier disclosed embodiments. However, only one forward (pull strap) section 200 is now utilized.

As shown, forward (pull strap) section 200, and more particularly elongated strap body 201, may be a multi-layered strap comprising a first layer 230 and a second layer 232 which are fastened together by fasteners 234 (thread stitches) at spaced intervals along the length of the forward (pull strap) section 200, such that a plurality of passages 236 are formed between the layers 230, 232 along the length of the forward (pull strap) section 200.

As shown, foot holder 110 further comprises a toe region (strap) section 260, which comprises an elongated strap body 261 and forms an adjustable length, closeable/openable enclosed foot (toe region) loop 262 which, depending on width, overlies/encircles around the top side 20, inner side 24, bottom side 22 and outer side 26 of the distal forefoot section 12, particularly at a distal end region of the metatarsals, and more particularly the head and/or distal shaft portion of the metatarsals, and/or a proximal end region of the proximal phalanges, and more particularly the base and/or proximal shaft portion of the proximal phalanges. As such, it also be understood that the toe region (strap) section 260 may overlie/encircle the metatarso phalangeal joints.

As shown, the strap body 261 is fastened by at least one end loop 264, 266 at each end of the strap body 261 to a plastic or metal annular ring/loop 268, with the annular ring/loop 268 extending through opening 263 of each loop 265, 266. As shown, the annular ring/loop 268 may be a carabiner, which may also be referred to as a snap hook, snap link, or spring snap. A carabiner may be understood to be an openable/closable plastic or metal ring/loop, which is made openable/closable by a spring-loaded gate.

In the foregoing manner, when the ring/loop 268 is open, the loops 264, 266 of the strap body 261 may be separated from the open ring/loop 268. In the foregoing manner, when each end of the strap body 261 includes a plurality of end loop 264, 266 which are arranged in series (like the passages 236 of strap body 201). different end loops 264, 266 may be used to engage with the ring/loop 268 to change (increase/decrease) the diameter/circumference of the foot (toe region) loop 262. It should be understood that the end loops 264, 266 above are permanently closed, fixed length loops, which may be particularly formed by folding an end portion back onto an adjacent portion of the strap body 261 and permanently stitching (e.g. stitches 172) the end portion and the adjacent portion to one another with thread to form the end loops 264, 266. Alternatively, the location/size/position of the loops 264, 266 may adjustable by making at least one of the loops 264, 266 openable and closable, such as by use of a releasable fastener, such as a hook-an-loop fastener, in similar fashion to loops 210.

Figure 5A:
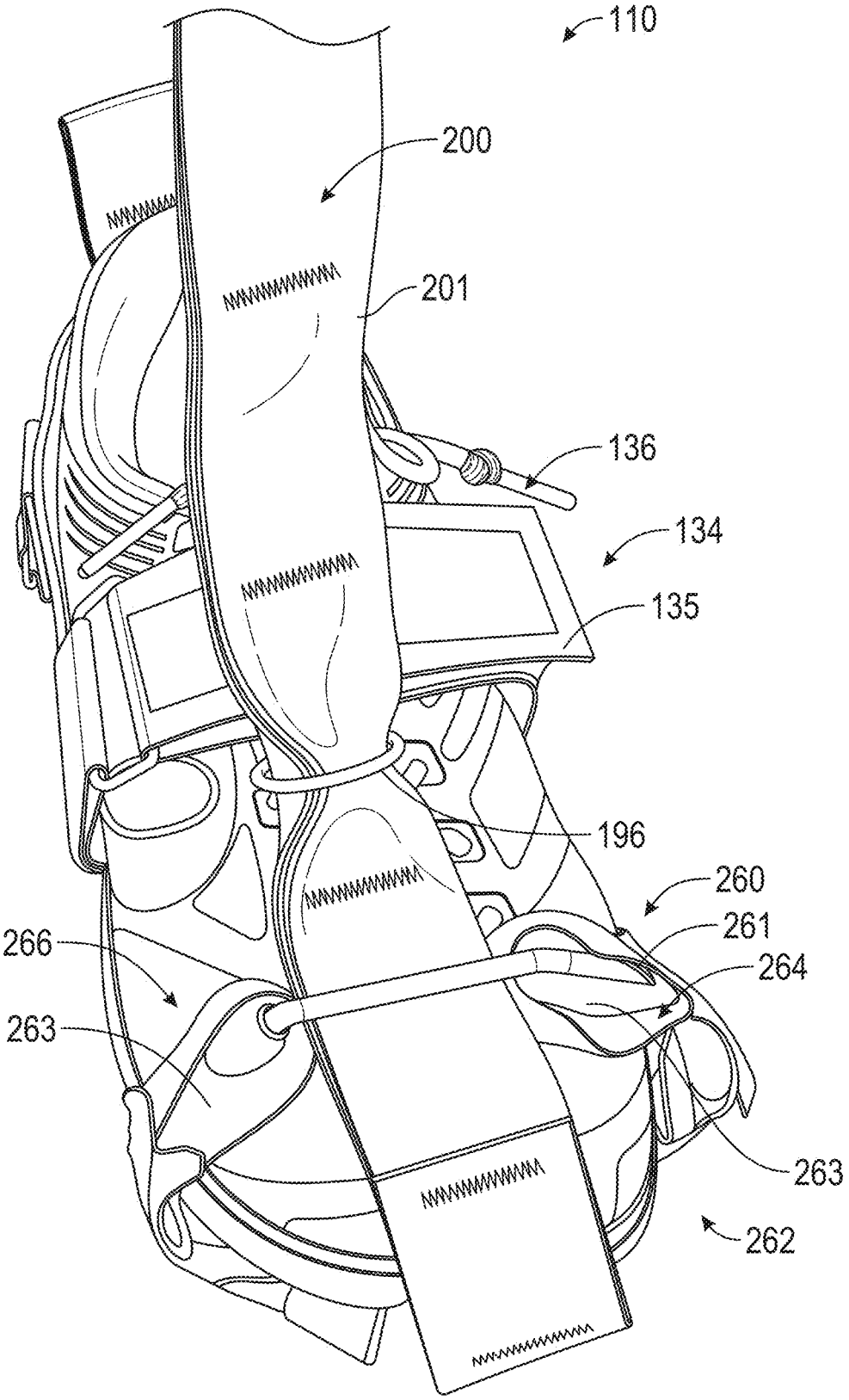
FIG. 5A is a top (dorsal) perspective view of a foot holder of another embodiment of exercise apparatus according to the present disclosure.
Figure 5B:
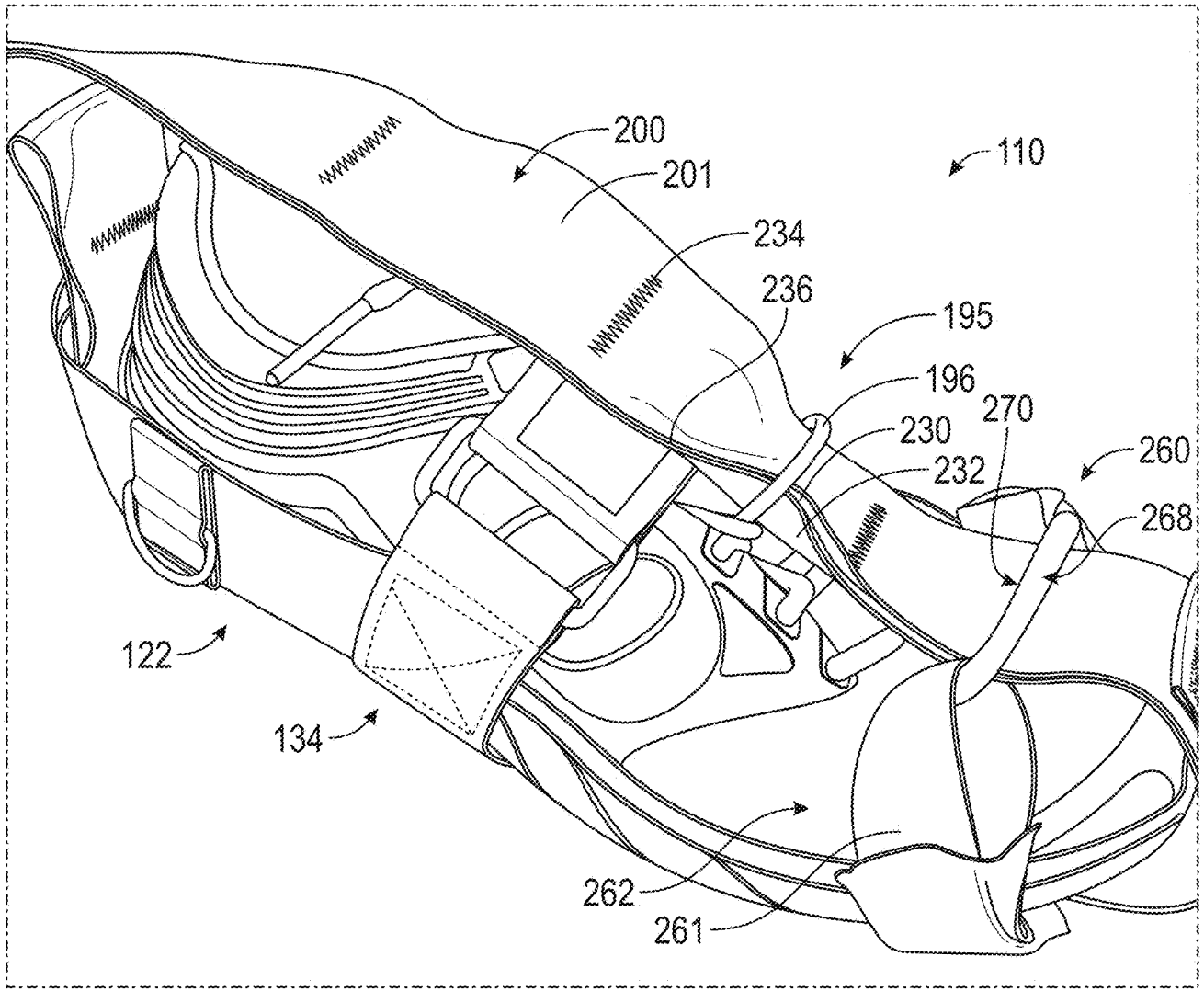
FIG. 5B is a an outer (lateral) perspective view of the foot holder of FIG. 5A.
Figure 5C:
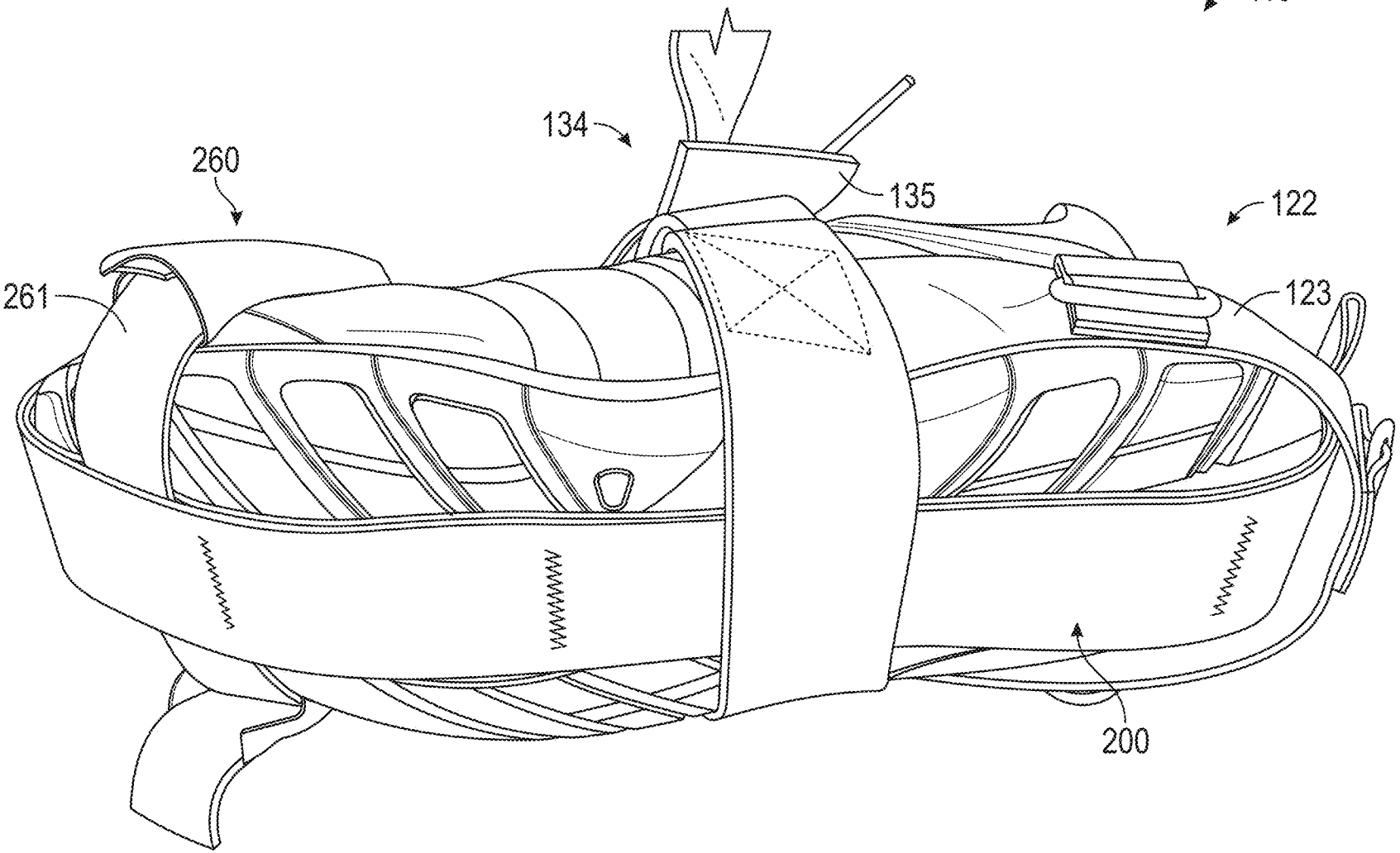
FIG. 5C is an inner (medial) perspective view of the foot holder of FIG. 5A.
Figure 5D:
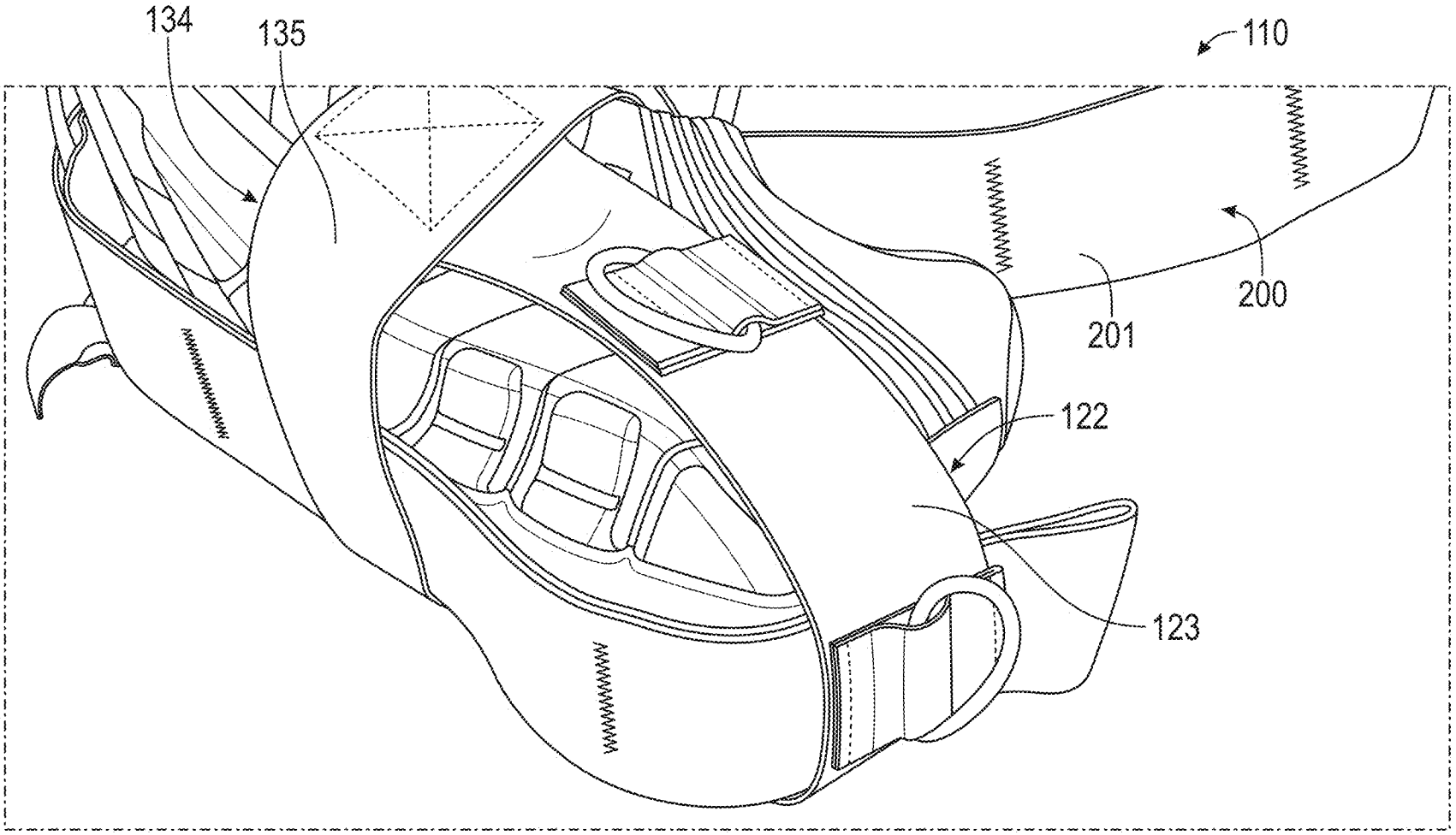
FIG. 5D is a rear (posterior) perspective view of the foot holder of FIG. 5A.
Figure 5E:
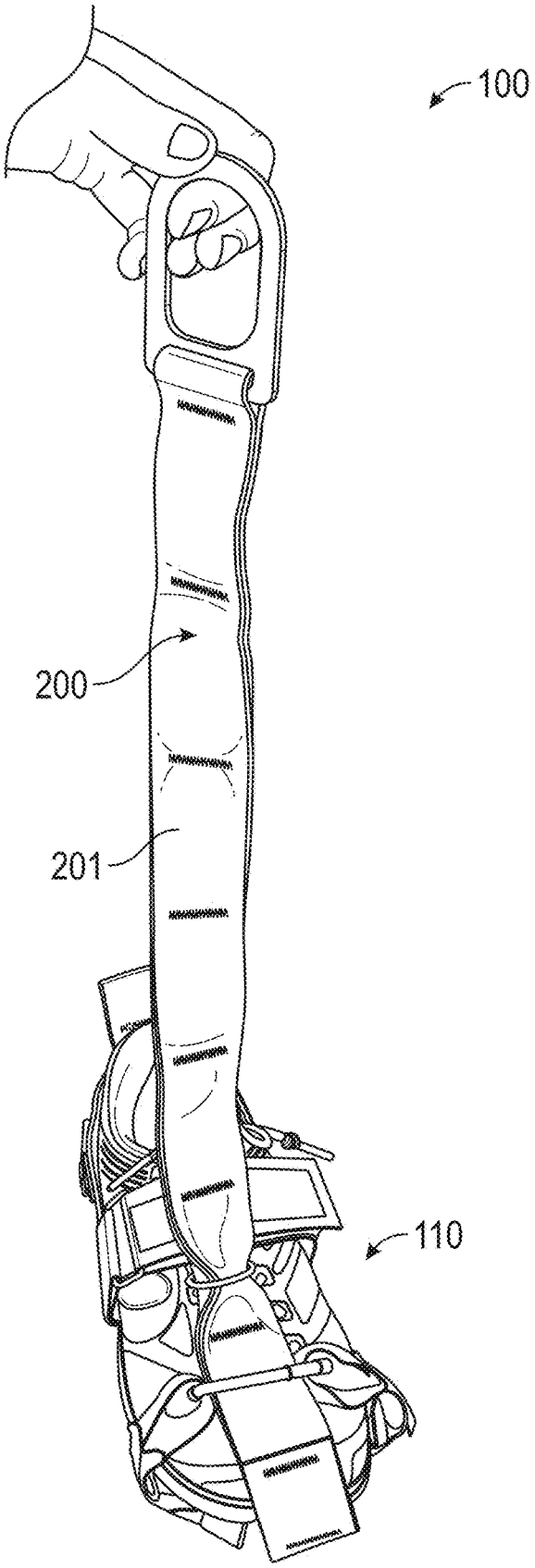
FIG. 5E is another top (dorsal) perspective view of the foot holder of FIG. 5A.
Figure 6A:
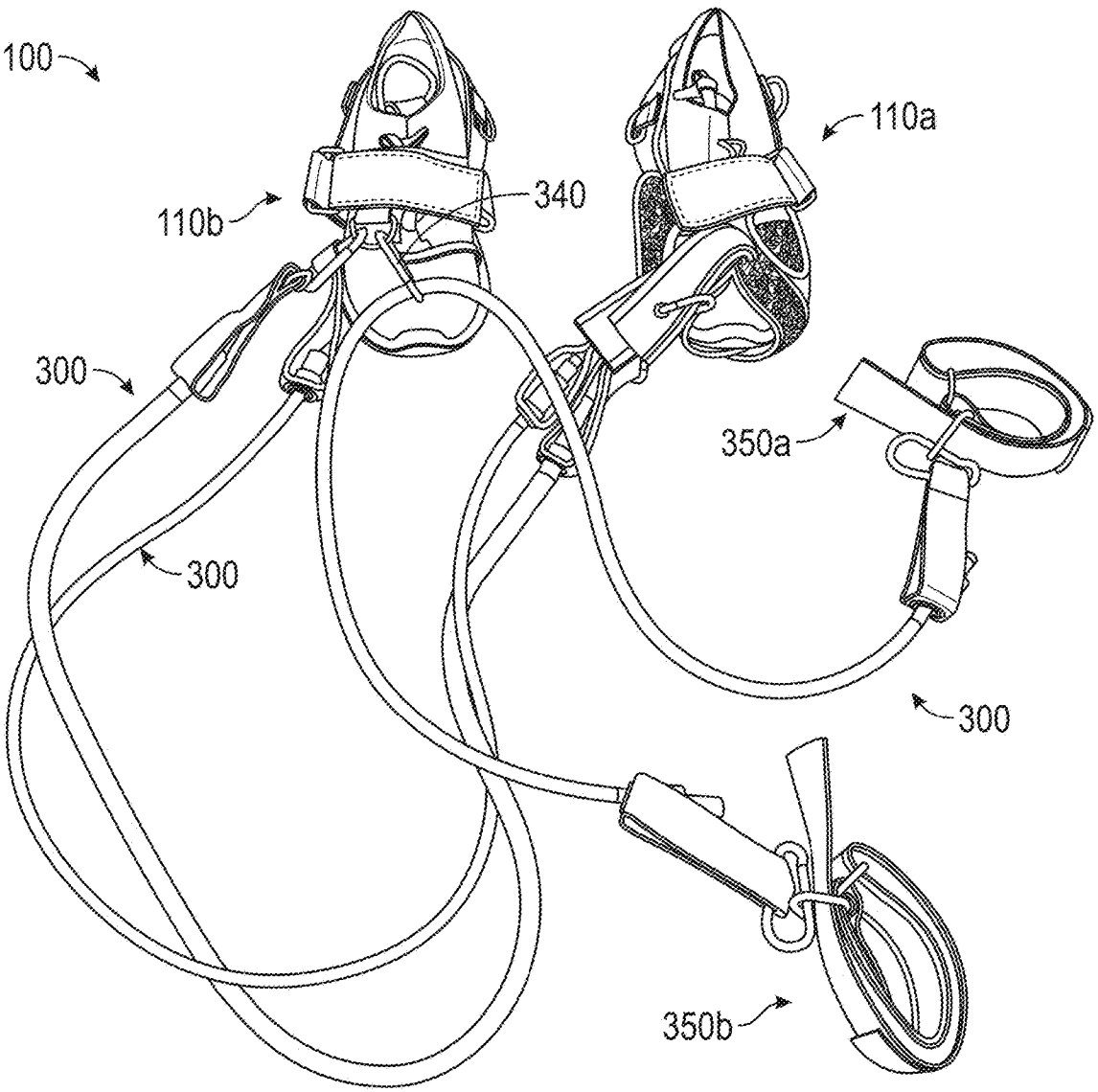
FIG. 6A is a perspective view of the exercise apparatus of FIG. 3A with an arm-to-arm tether connected to a foot holder.
Figure 6B:
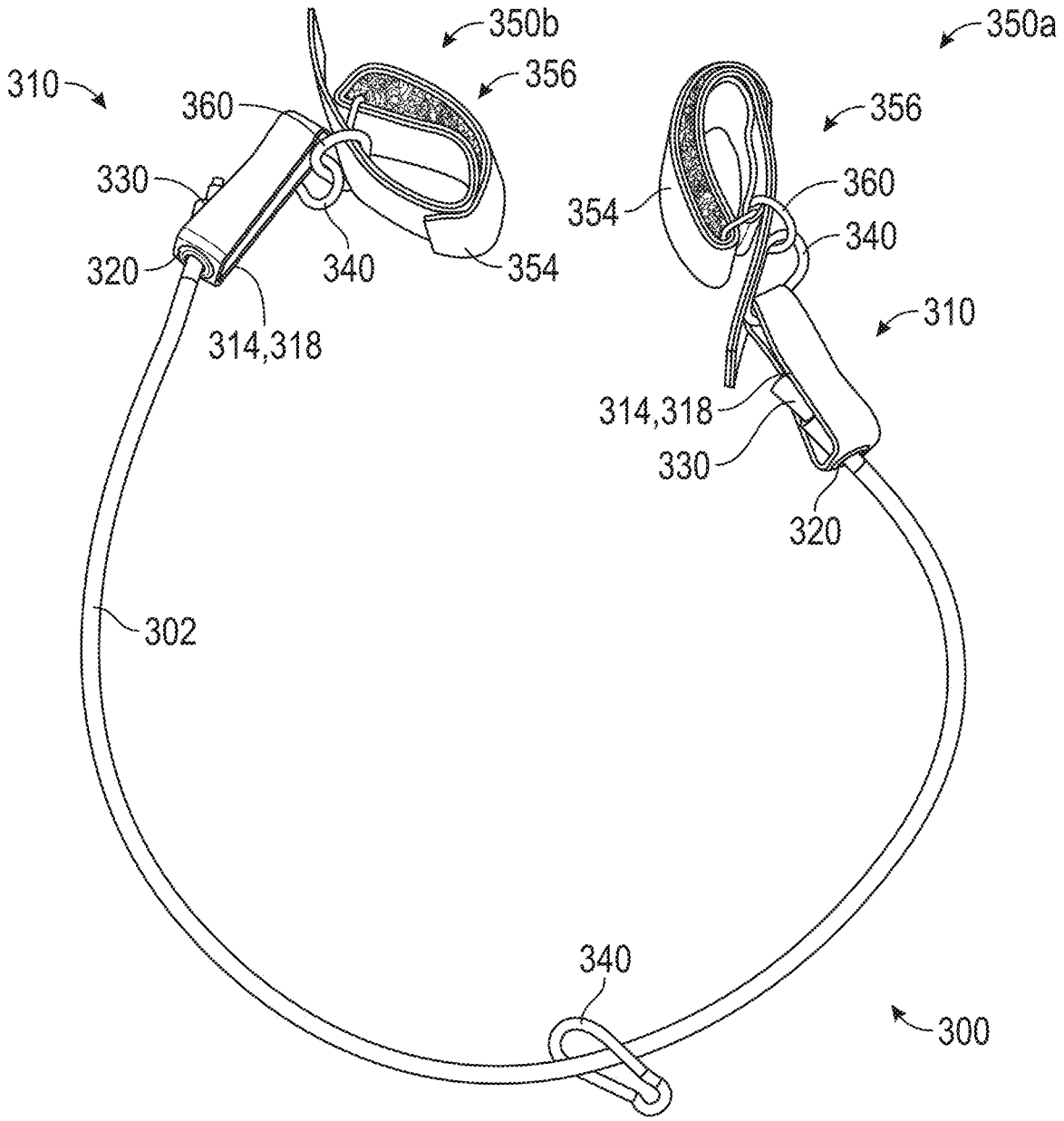
FIG. 6B is a perspective view of the arm-to-arm tether of FIG. 6A.
Figure 6C:
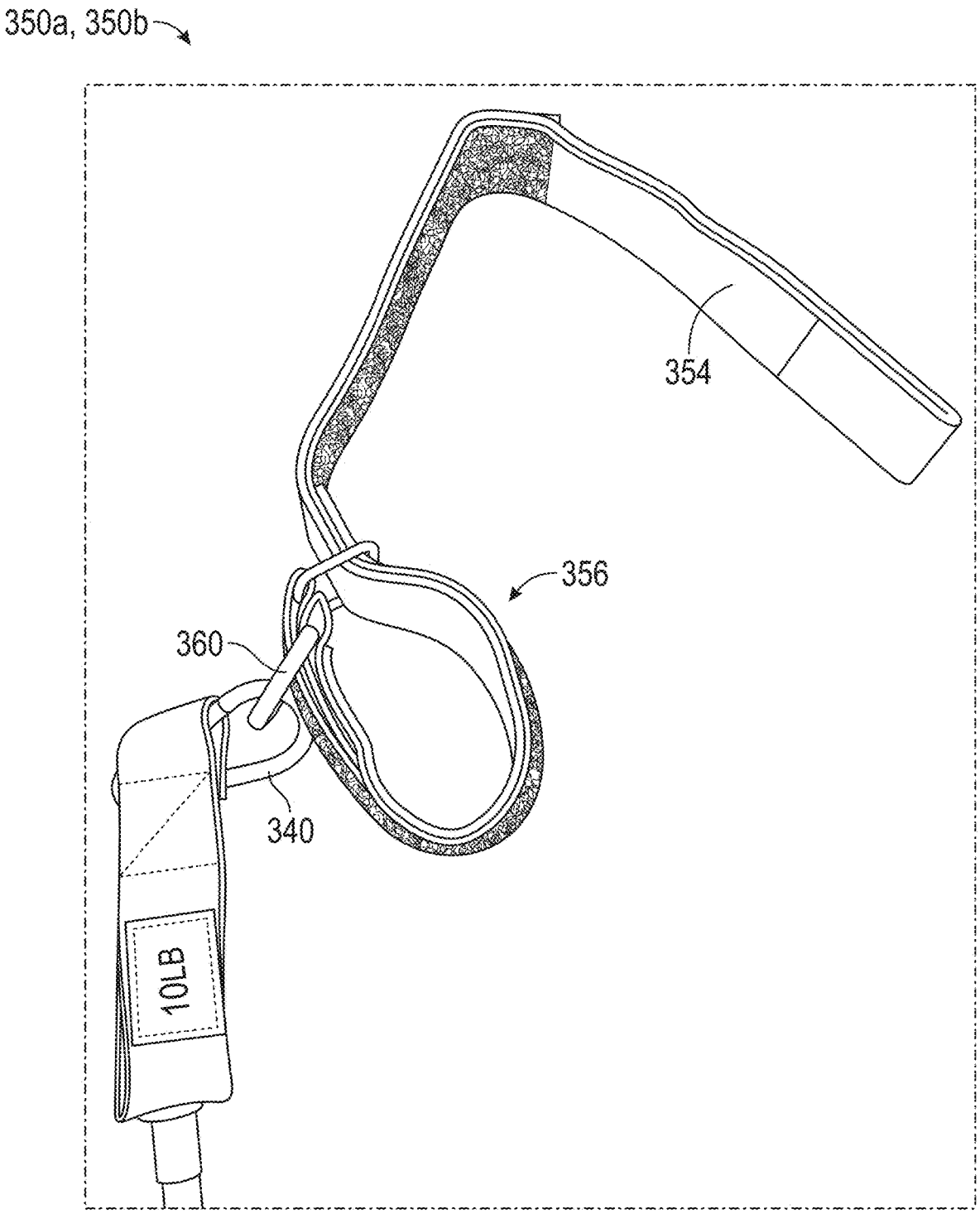
FIG. 6C is a close-up perspective view of a wrist holder of the arm-to-arm tether of FIG. 6B.
Figure 6D:
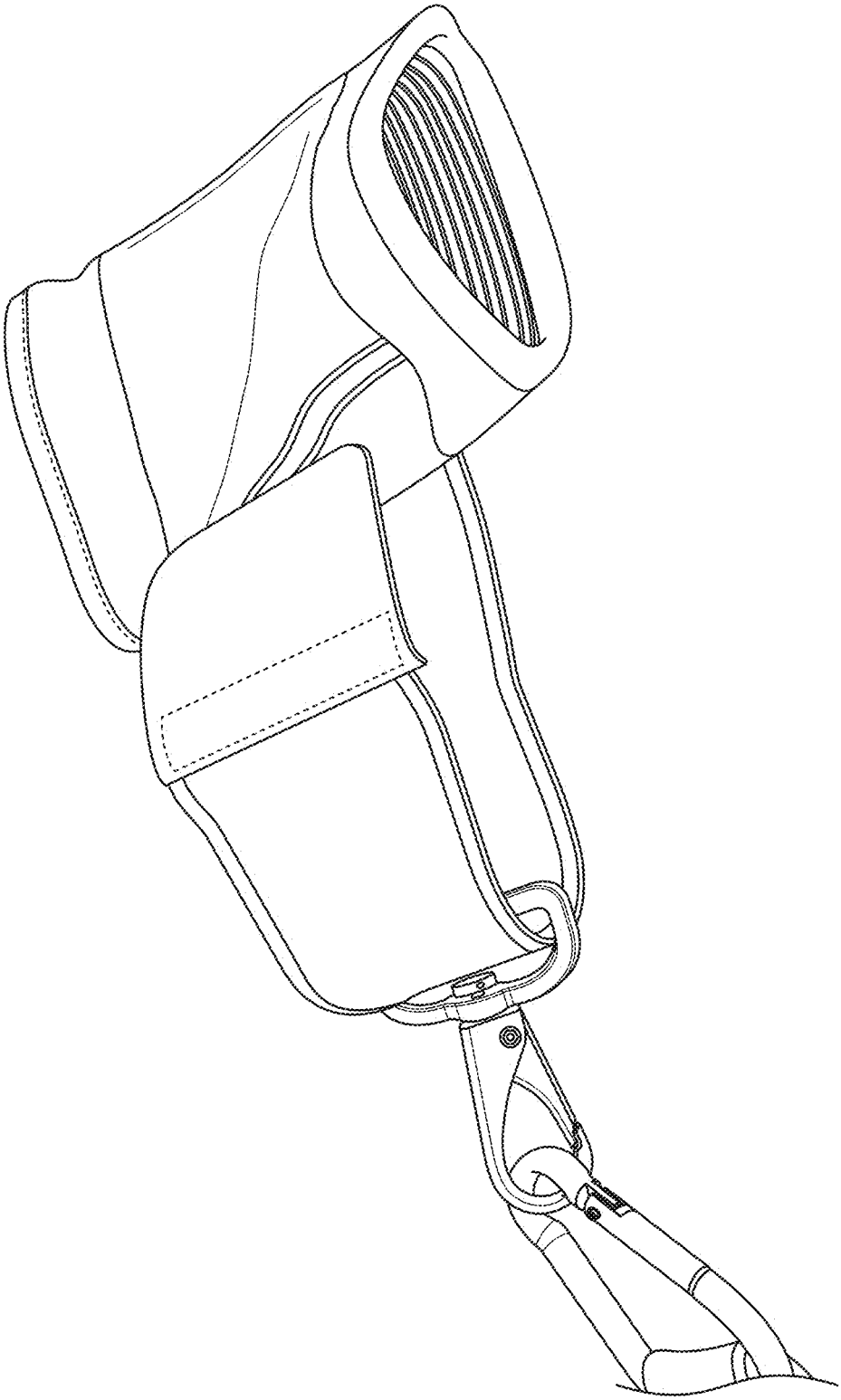
FIG. 6D is a close-up perspective view of an alternative wrist holder according to the present disclosure.
Figure 6E:
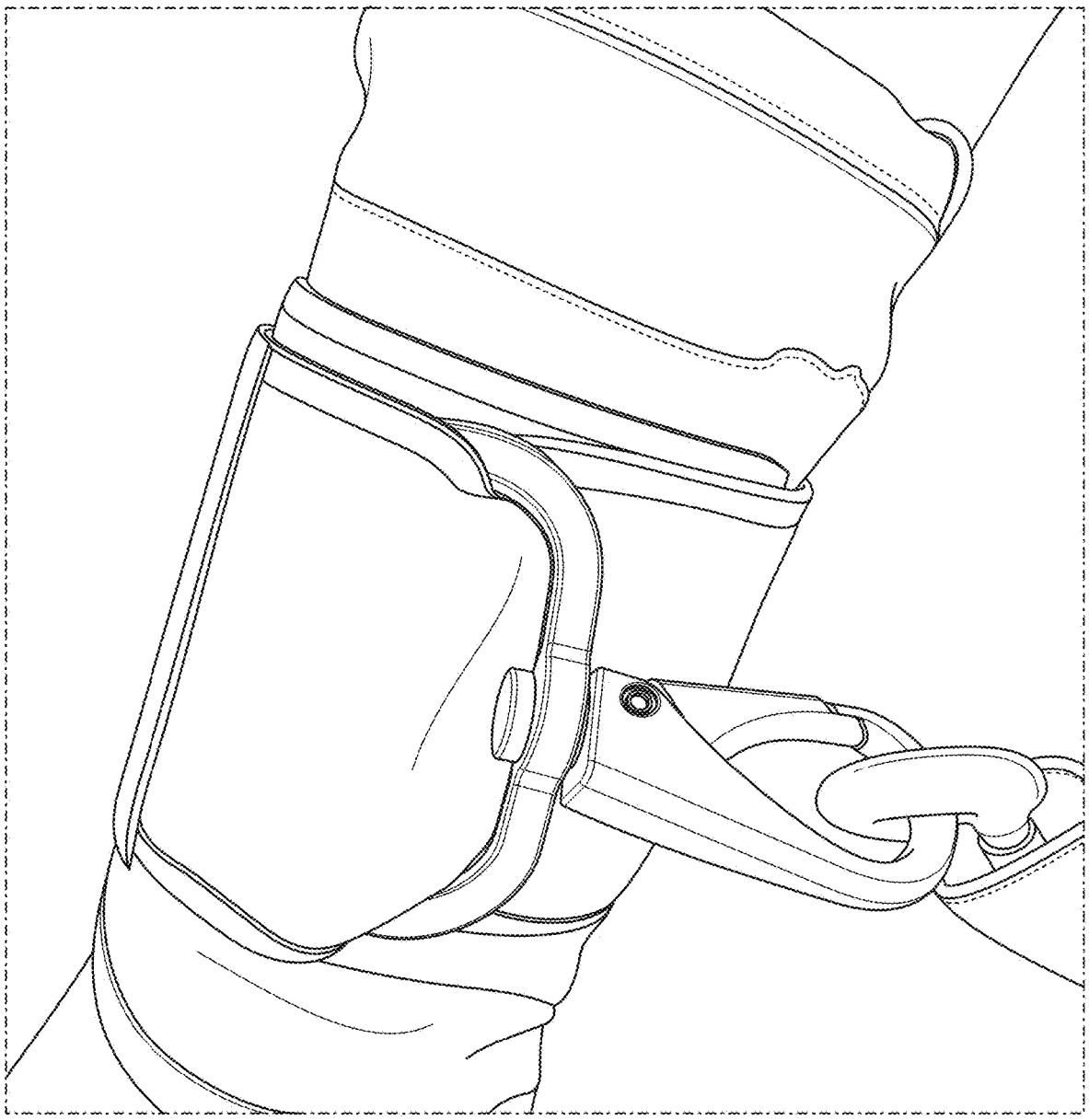
FIG. 6E is another close-up perspective view of the alternative wrist holder of FIG. 6D.

As shown, forward (pull strap) section 200 extends through opening 198 of annular (ring/eyelet) anchor 196 and thereafter opening 270 of annular ring/loop 268, after which the forward (pull strap) section 200 wraps from the top side 12 to the bottom side 22 of distal forefoot section 12. As shown by FIG. 5C, on the bottom side 22 of the distal forefoot section 12, the toe region (strap) section 260, and more particularly strap body 261 extends through one of the passages 236 formed between the first layer 230 and the second layer 232 of the strap body 201 of forward (pull strap) section 200. Moreover the toe region (strap) section 260 is disposed between two of the fasteners 234 of the forward (pull strap) section 200. In such manner, the toe region (strap) section 260 is held in place between the two fasteners 234. The two fasteners 234 are spaced to permit the toe region (strap) section 260 to move anteriorly and posteriorly a limited distance as to better accommodate different users of foot holder 110 with different sized feet. However, while the positioning of the fasteners 234 allows anterior and posterior positioning adjustment of the toe region (strap) section 260, the fasteners 234 inhibit the toe region (strap) section 260 from traveling too far along the length of foot 10 anteriorly or posteriorly as to be improperly positioned.

Similar to toe region (strap) section 260, central (strap) section 134 may also be disposed between the first layer 230 and the second layer 232 of the strap body 201 of forward (pull strap) section 200, as well as two of the fasteners 234 of the forward (pull strap) section 200, to limit movement of the central (strap) section 134 anteriorly and posteriorly. Alternatively, as shown, the central (strap) section 134 may overlie both layers 230, 232 of the strap body 201 of the forward (pull strap) section 200, or underlie both layers 230, 233, of the strap body 201 of the forward (pull strap) section 200.

Continuing posteriorly, the forward (pull strap) section 200 then wraps from the bottom side 22 to the rear end 30 of foot 12, where it is fastened to strap body 123 of rearward (strap) 122 section.

Referring to FIGS. 6A-6E, in addition to the foregoing, exercise apparatus 100 may further comprise a left wrist holder 350*a* and right wrist holder 350*b*, which may be connected by at least one tether 300. As shown left wrist holder 350*a* and right wrist holder 350*b* may each comprise a strap 354, which forms an adjustable length, closeable/openable wrist loop 356, and a metal annular ring/loop 360, which is shown as a D-ring, which is used to connect with the releasably fastenable fastener 340 of tether 300.

Referring to FIGS. 7A-7F, there is shown a foot holder comprising a shoe 40 having a sole 42, with a bottom (tread) surface 44 of the shoe 40/sole 42 to tread on. As shown the sole 42 is configured to underlie foot 10 when disposed in shoe 40, and extends continuously beneath the front end 28 of the foot 10 to the rear end 30 (heel) of the foot 10 and from the inner side 24 to the outer side 26.

As shown, the sole 42 includes an elongated linear recess 50 which extends continuously from a front end 46 of the shoe 40/sole 42 to a rear end 48 of the shoe 40/sole 42.

Within recess 50 are disposed one or more discrete anchors 60 to releasably fasten with forward (pull strap) section 200, as explained in greater detail below. As shown, a plurality of anchors 60 are arranged in a linear row, spaced apart from each other and extending along a length of the recess 50. The anchors 60 may be spaced apart from each other in a range of 0.75 inch to 6 inches, and more particularly 1 inch to 4 inches, and even more particularly 1.5 inches to 3 inches. The anchors 60 each provide a first releasable fastener member in the form of a latch, which releasably fastens with a second releasable fastener member of the forward (pull strap) section 200.

Figures 7A, 7B, 7C, 7D, 7E, 7F:
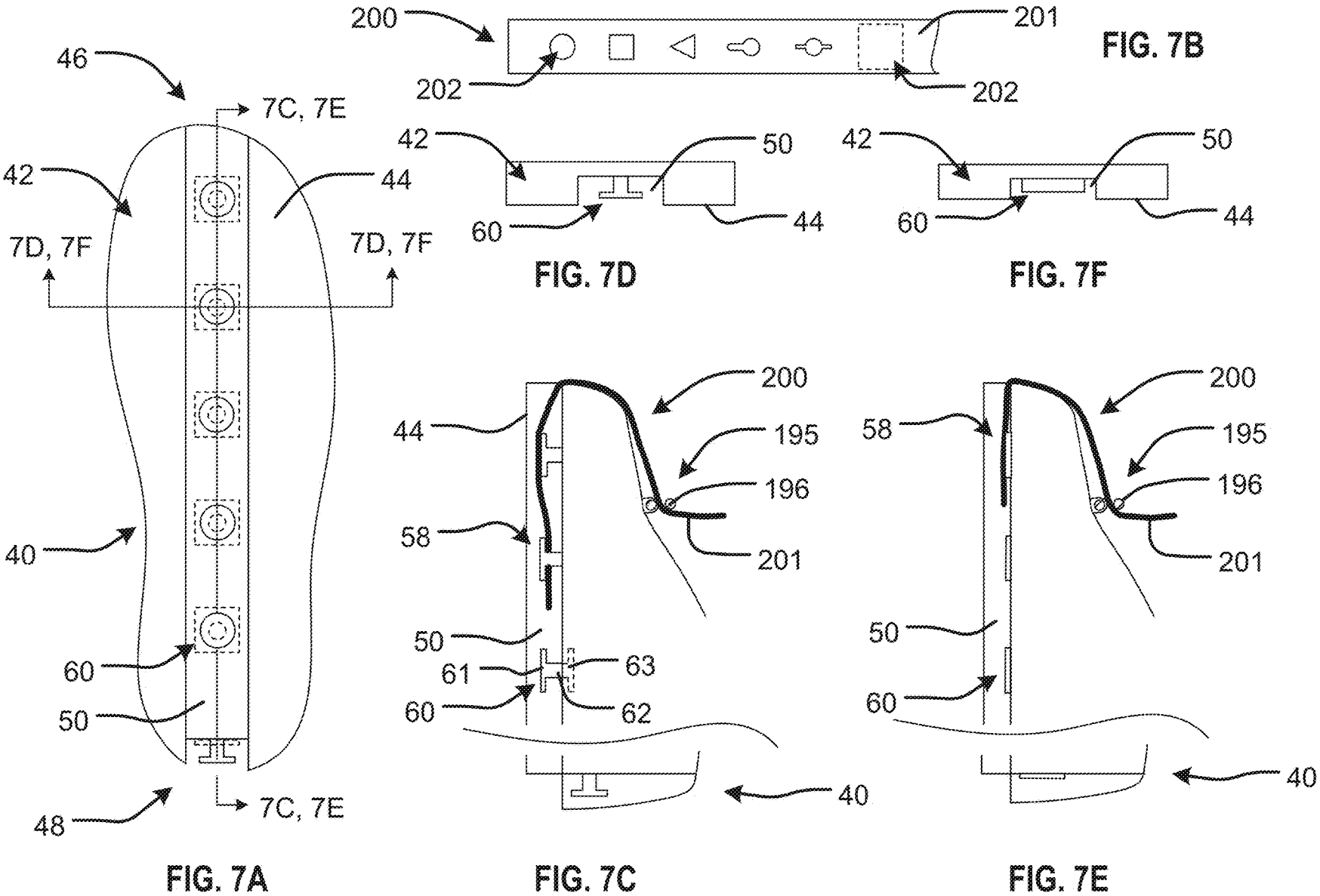
FIG. 7A is bottom (planum) side view of a foot holder of another embodiment of exercise apparatus according to the present disclosure.
FIG. 7B is a strap for use with the foot holder of FIG. 7A.
FIG. 7C is a cross-sectional view of the foot holder of FIG. 7A taken along line 7C-7C.
FIG. 7D is a cross-sectional view of the foot holder of FIG. 7A taken along line 7D-7D.
FIG. 7E is a cross-sectional view of another embodiment of the foot holder of FIG. 7A taken along line 7E-7E.
FIG. 7F is a cross-sectional view of the foot holder of FIG. 7A taken along line 7F-7F.

As shown in FIGS. 7A, 7C and 7D, in one embodiment, anchors 60 may each comprise a mechanical (metal) fastener member, which more particularly may be a rivet fastener. The anchor/fastener member 60 may comprise an exposed circular head 61 and an adjacent adjoining exposed cylindrical neck 62. A hidden circular base 63 may be connected (e.g. molded-in or otherwise embedded) to the sole 42. The circular head 61 and base 63 may each be understood to have a diameter larger than a diameter of the cylindrical neck 62.

As shown, the anchor/fastener member 60 is completely disposed with the recess and does not break an imaginary plane of the bottom (tread) surface 44 of the shoe 40/sole 42. In this manner, when the shoe 40/sole 42 is treaded on, the anchor/fastener 60 does not make contact with the contacting surface and hence is not damaged. An anchor/fastener member 60 may also be disposed in recess 50 on the rear end of the shoe 40.

Turning to FIG. 7B, forward (pull strap) section 200 may comprise a one or more discrete enclosed (window) openings 202 in strap body 201. As shown, a plurality of openings 202 are arranged in a linear row, spaced apart from each other and extending along a length of the strap body 201. The openings 202 may be spaced apart from each other in a range of 0.75 inch to 6 inches, and more particularly 1 inch to 4 inches, and even more particularly 1.5 inches to 3 inches. The openings 202 each provide a second releasable fastener member in the form of a catch, which releasably fastens with the anchor/fastener member 60 of the shoe 40 by being disposed over the head 61 onto the neck 62, as shown in FIG. 7C.

As shown in FIG. 7C, the opening/fastener member 202 may be disposed over and engage any one of the anchor/fastener members 60 spaced along the length of the sole 42 depending on preference and/or comfort to the user. Thus, as shown, it should be understood that a releasably fastenable fastener 58 is provided by anchor/first releasable fastener member 60 and mating second releasable fastener member 202.

As shown by FIG. 7B, opening 202 may be circular, polygonal or triangular. Opening 202 may also have a circular portion and a slot portion, or a circular portion and a plurality of surrounding slotted portions, particularly on opposite sides of the circular portion, spaced at 170-180 degrees relative to each other.

In another embodiment as shown in FIGS. 7A, 7B, 7E and 7F, the releasable fastener member 58 may be a hook-and-loop fastener (e.g. Velcro brand hook-and-loop fastener). First releasable fastener member 60 may be the hook fastener member and second releasable fastener 202 may be the loop fastener member, or vice-versa, which may be understood to be mating fastener members. First releasable fastener member 60 is connected to the sole 42, by being adhesively bonded, welded or molded-in (or otherwise embedded) to the sole 42, while second fastener member 202 is connected to the strap body stitches.

It should be understood that the releasable fasteners described herein provide releasable mechanical engagement, which may be understood herein as a connection formed between the components which does not rely solely on friction to inhibit separation of the components and which includes a mechanical interlock configured to inhibit separation of the components (e.g. mechanical interference). Such connection may also be referred to in the art as a positive mechanical engagement connection, again to distinguish mechanical engagement from mere friction.

It should be understood that in describing components as being "permanently" affixed, thread stitched or otherwise, that such is not intended to be removable, and generally may only be removed with at least some destruction of the component(s).

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

LIST OF REFERENCE CHARACTERS

10 foot
12 forefoot section
14 midfoot section
16 hindfoot section
20 top side (dorsal aspect, dorsum)
22 bottom side (planum aspect or sole)
24 inner side (medial aspect)
26 outer side (lateral aspect)
28 front end (anterior aspect)
30 rear end (posterior aspect)
32 ankle joint
34 tibia
36 fibula
40 shoe
42 sole
44 bottom (tread) surface

46 front end
48 rear end
50 recess
58 releasably fastenable fastener
60 anchor/fastener
61 head
62 neck
63 base
100 exercise apparatus
110 foot holder (left 110*a*, right 110*b*)
120 foot harness
122 rearward (strap) section
123 elongated strap body
124 first (medial) end portion
126 lateral end portion
134 central (strap) section
135 elongated strap body
136 foot loop
142 medial side portion
144 lateral side portion
146 first (lateral end) loop
148 first (lateral) end
150 first end portion
152 adjacent portion
153 loop
154 end portion
155 adjacent portion
156 second (medial end) loop
158 second (medial) end
160 second end portion
162 adjacent portion
164 intermediate portion
170 fastener
172 thread stitches
174 rows of thread stitching
180 ring/loop
182 opening
190 releasably fastenable fastener
192 first releasable fastener member
194 second releasable fastener member
195 strap guide
196 annular (ring/eyelet) anchor
198 opening
200 forward (pull strap) section(s) (200, 200*a*, 200*b*, 200*c*)
201 elongated strap body (201*a*. 201*b*)
202 opening
210 first loop
212 first end
214 first end portion
216 adjacent portion
220 second end portion
224 opening
226 ring
230 first layer
232 second layer
234 fastener
236 passages
260 toe region (strap) section
261 elongated strap body
262 loop
263 opening
264 end loop
266 end loop
268 ring/loop
270 opening
300 connecting tether
302 connecting line
310 coupling
314 strap
318 loop
320 ring
330 anchor
340 releasably fastenable fastener
350 wrist holder (left 350*a*, right 350*b*)
354 strap
356 loop
360 loop
F force
A anchor
A1 anchor
A2 anchor
A3 anchor ring
S strap

What is claimed is:

1. An exercise apparatus, comprising:

a foot holder to be disposed on a human foot;

the foot holder including a pull strap having an end free of the foot holder, and a strap guide having an opening;

the strap guide positioned such that, when the foot holder is disposed on the foot, the strap guide lies adjacent a top side of a midfoot section of the foot and/or lies adjacent one or more metatarsals of a forefoot section of the foot;

the pull strap operable such that, when the foot holder is disposed on the foot, the pull strap extends from a bottom side of the foot around one or more phalanges of the foot and along the top side of the foot through the opening of the strap guide and away from the foot holder with the end of the pull strap free of the foot holder; and the pull strap operable with the strap guide such that, when a pulling force is applied to the pull strap which extends through the opening of the strap guide, the pull strap slides on the strap guide to direct the pulling force along the top side of the foot around the one or more phalanges of the foot to the bottom side of the foot, whereby the bottom side of the foot is brought into tension by the pulling force.

2. The exercise apparatus of claim 1, wherein:

the pull strap is fastened to the foot holder at a location of the foot holder positioned to lie adjacent the bottom side of the foot.

3. The exercise apparatus of claim 2, wherein:

the location of the foot holder positioned to lie adjacent the bottom side of the foot is at the forefoot section and/or at the midfoot section of the foot.

4. The exercise apparatus of claim 2, wherein:

the foot holder further comprises a central section, comprising an adjustable length loop, positioned to encircle the forefoot section and/or the midfoot section of the foot; and wherein the pull strap is fastened to the adjustable length loop.

5. The exercise apparatus of claim 4, wherein:

the pull strap is permanently fastened to the adjustable length loop with thread.

6. The exercise apparatus of claim 4, wherein:

the strap guide is coupled to the adjustable length loop by a strap guide anchor loop permanently fastened to the adjustable length loop with thread.

7. The exercise apparatus of claim 4, wherein:

the foot holder further comprises a rearward section which extends around a hindfoot section of the foot and is fastened to the central section at a position to lie adjacent an inner side and at a position to lie adjacent an outer side of the foot.

8. The exercise apparatus of claim 7, wherein:

the rearward section is permanently or releasably fastened to the central section at the positions to lie adjacent the inner side and at the position to lie adjacent the outer side of the foot with thread.

9. The exercise apparatus of claim 4, wherein:

the foot holder further comprises a toe region section, comprising a loop, positioned to encircle a toe region of the forefoot section of the foot; and wherein the loop includes a ring through which the pull strap passes through.

10. The exercise apparatus of claim 1, wherein:

the pull strap is fastened to the foot holder at a location of the foot holder positioned to lie adjacent a hindfoot section of the foot.

11. The exercise apparatus of claim 10, wherein:

the location of the foot holder positioned to lie adjacent the hindfoot section of the foot is at a rear end of the hindfoot section of the foot.

12. The exercise apparatus of claim 10, further comprising:

a rearward section positioned to lie adjacent the hindfoot section of the foot at a rear end of the hindfoot section of the foot; and wherein the pull strap is fastened to the rearward section where the rearward section is positioned to lie adjacent the hindfoot section of the foot at the rear end of the hindfoot section of the foot.

13. The exercise apparatus of claim 12, wherein:

the pull strap is permanently fastened to the rearward section with thread.

14. The exercise apparatus of claim 12, wherein:

the foot holder further comprises a central section, comprising an adjustable length loop, positioned to encircle the forefoot section and/or the midfoot section of the foot; and the rearward section extends around the hindfoot section of the foot and is fastened to the central section at a position to lie adjacent an inner side and at a position to lie adjacent an outer side of the foot.

15. The exercise apparatus of claim 14, wherein:

the rearward section is permanently or releasably fastened to the central section at the positions to lie adjacent the inner side and at the position to lie adjacent the outer side of the foot with thread.

16. The exercise apparatus of claim 12, wherein:

the foot holder further comprises a toe region section, comprising a loop, positioned to encircle a toe region of the forefoot section of the foot; and wherein the loop includes a ring through which the pull strap passes through.

17. The exercise apparatus of claim 1, wherein the strap guide comprises a closed annular ring.

18. The exercise apparatus of claim 17, wherein the closed annular ring is a D-ring.

19. The exercise apparatus of claim 1, wherein the strap guide is mounted to the foot holder with an anchor loop.

20. The exercise apparatus of claim 1, further comprising an elongated tether fastenable to the free end of the pull strap with a releasable fastener.

21. The exercise apparatus of claim 1, wherein the releasable fastener is a carabiner.

* * * * *